US007775261B2

(12) United States Patent
Valenzuela

(10) Patent No.: US 7,775,261 B2
(45) Date of Patent: Aug. 17, 2010

(54) CAPILLARY CONDENSER/EVAPORATOR

(75) Inventor: Javier A. Valenzuela, Grantham, NH (US)

(73) Assignee: Mikros Manufacturing, Inc., Claremont, NH (US)

( * ) Notice: Subject to any disclaimer, the term of this patent is extended or adjusted under 35 U.S.C. 154(b) by 1102 days.

(21) Appl. No.: 11/075,467

(22) Filed: Mar. 8, 2005

(65) Prior Publication Data

US 2005/0230085 A1 Oct. 20, 2005

Related U.S. Application Data

(63) Continuation-in-part of application No. 10/374,933, filed on Feb. 26, 2003, now Pat. No. 6,863,117.

(60) Provisional application No. 60/359,673, filed on Feb. 26, 2002.

(51) Int. Cl.
*F28D 15/00* (2006.01)
*H05K 7/20* (2006.01)

(52) U.S. Cl. ..... 165/104.26; 165/104.21

(58) Field of Classification Search ..... 165/80.4, 165/104.21, 104.31, 104.33, 147; 361/699, 361/700

See application file for complete search history.

(56) References Cited

U.S. PATENT DOCUMENTS

| | | | | |
|---|---|---|---|---|
| 3,525,670 | A | 8/1970 | Brown | 376/329 |
| 3,857,441 | A | 12/1974 | Arcella | 165/104.26 |
| 4,351,388 | A | 9/1982 | Calhoun et al. | |
| 4,515,209 | A | 5/1985 | Maidanik et al. | 165/104.22 |
| 4,903,761 | A * | 2/1990 | Cima | 165/104.25 |
| 5,023,695 | A * | 6/1991 | Umezawa et al. | 257/714 |
| 5,303,768 | A * | 4/1994 | Alario et al. | 165/104.26 |
| 5,761,037 | A | 6/1998 | Anderson et al. | 361/700 |
| 5,944,092 | A | 8/1999 | Van Oost | 165/104.26 |
| 6,014,312 | A | 1/2000 | Schulz-Harder et al. | |
| 6,227,288 | B1 | 5/2001 | Gluck et al. | 165/104.26 |
| 6,241,008 | B1 | 6/2001 | Dunbar | 165/104.26 |
| 6,293,333 | B1 | 9/2001 | Ponnappan et al. | 165/104.26 |
| 6,330,907 | B1 * | 12/2001 | Ogushi et al. | 165/104.26 |
| 6,388,882 | B1 | 5/2002 | Hoover et al. | 361/704 |
| 6,446,706 | B1 | 9/2002 | Rosenfeld et al. | 165/46 |
| 6,448,063 | B2 | 9/2002 | Sehmbey et al. | 165/96 |

(Continued)

FOREIGN PATENT DOCUMENTS

GB 2 312 734 A 11/1997

(Continued)

*Primary Examiner*—Tho V Duong

(57) ABSTRACT

A heat transfer device is disclosed for transferring heat to or from a fluid that is undergoing a phase change. The heat transfer device includes a liquid-vapor manifold in fluid communication with a capillary structure thermally connected to a heat transfer interface, all of which are disposed in a housing to contain the vapor. The liquid-vapor manifold transports liquid in a first direction and conducts vapor in a second, opposite direction. The manifold provides a distributed supply of fluid (vapor or liquid) over the surface of the capillary structure. In one embodiment, the manifold has a fractal structure including one or more layers, each layer having one or more conduits for transporting liquid and one or more openings for conducting vapor. Adjacent layers have an increasing number of openings with decreasing area, and an increasing number of conduits with decreasing cross-sectional area, moving in a direction toward the capillary structure.

28 Claims, 20 Drawing Sheets

U.S. PATENT DOCUMENTS

| | | | | |
|---|---|---|---|---|
| 6,450,132 | B1 * | 9/2002 | Yao et al. | 122/366 |
| 6,460,612 | B1 | 10/2002 | Sehmbey et al. | 165/96 |
| 6,863,117 | B2 * | 3/2005 | Valenzuela | 165/104.26 |
| 6,951,243 | B2 * | 10/2005 | Nilson et al. | 165/104.21 |
| 6,988,534 | B2 * | 1/2006 | Kenny et al. | 165/80.4 |
| 7,188,662 | B2 * | 3/2007 | Brewer et al. | 165/80.4 |
| 2001/0050162 | A1 * | 12/2001 | Valenzuela | 165/80.4 |
| 2002/0043220 | A1 | 4/2002 | Yao et al. | |
| 2003/0042009 | A1 * | 3/2003 | Phillips | 165/104.26 |
| 2004/0206477 | A1 * | 10/2004 | Kenny et al. | 165/80.4 |

FOREIGN PATENT DOCUMENTS

| | | | |
|---|---|---|---|
| WO | WO 03/073032 | A1 | 9/2003 |

* cited by examiner

CAPILLARY CONDENSER/EVAPORATOR

CROSS REFERENCES TO RELATED APPLICATIONS

This application is a continuation-in-part of U.S. application Ser. No. 10/374,933, filed Feb. 26, 2003 now U.S. Pat. No. 6,863,117, entitled "Capillary Evaporator," which claims priority to U.S. Provisional Patent Application No. 60/359,673, filed Feb. 26, 2002 and entitled "Fractal Capillary Evaporator." The entire contents of the above applications are incorporated herein by reference in entirety.

STATEMENT REGARDING FEDERALLY SPONSORED RESEARCH OR DEVELOPMENT

This invention was made with Government support under contract No. NAS 5-02112 awarded by NASA. The government has certain rights to this invention.

BACKGROUND OF THE INVENTION

The present invention relates generally to the field of thermal management systems. More particularly, the present invention is directed to a heat transfer device for transferring heat to or from a fluid that is undergoing a phase change.

Capillary condensers and evaporators are used in a variety of two-phase thermal management systems. As will be appreciated, many devices may be used as either an evaporator or a condenser, the difference between the two being primarily the direction of flow for the heat, liquid and/or vapor, as appropriate. In capillary evaporators nucleate boiling does not occur, as opposed to flow-through, or kettle boilers, where it does occur. In a capillary evaporator, evaporation takes place at a liquid-vapor interface held stable by a capillary wick structure. The liquid supplied to the evaporator is at a pressure lower than the vapor pressure, and the liquid is drawn into the evaporator by the capillary suction of the wick.

A common style capillary evaporator is the configuration used in heat pipes. One such conventional prior art heat pipe is illustrated in FIG. 1A. As illustrated, the heat pipe 10 may typically consist of a tube 11 containing a porous layer or capillary wick 12 in contact with, and generally bonded to, the inner surface 13 of the tube. One section of the heat pipe 10, typically one end, absorbs heat from a heat source and functions as an evaporator 14. Another portion, typically the opposing end, rejects heat to a heat sink and functions as a condenser 15. The capillary wick returns the liquid from the condenser portion to the evaporator portion of the heat pipe via the capillary suction of the wick. The inner surface of the wick defines a central passageway that conducts vapor from the evaporator portion to the condenser portion of the heat pipe. The capillary wick can be fabricated in a variety of different ways, such as by machined grooves, a discrete metal screen, sintered metal powder, or a plasma-deposited porous coating, to name a few examples. Heat pipes are economical to fabricate and work well in applications with modest heat fluxes and relatively short heat transport distances. For example, many contemporary high-performance laptop computers use heat pipes to remove heat from the processor and transfer it to the case.

Within a heat pipe, the liquid has to flow a substantial distance from the condenser portion to the evaporator portion through the capillary wick. This creates a large pressure drop for the liquid that effectively limits the maximum liquid flow rate, thereby limiting the heat transport capacity of the heat pipe. If the pore size of the wick is decreased to provide higher capillary suction, the permeability of the wick decreases and the pressure drop increases. Increasing the thickness of the wick reduces the pressure drop, but increases the distance the heat must be conducted through the wick at the evaporator portion of the heat pipe. Increasing the thickness of the wick translates into a higher thermal resistance at the evaporator portion and, perhaps more limiting, an increase in the liquid superheat at the interface between the inner surface of the tube and the wick. Eventually, the superheat at the base of the wick becomes too large and boiling takes place in the wick, leading to a drying out of the wick. When the wick dries out, the performance of the wick degrades substantially.

Many applications, including spacecraft thermal management systems, need higher heat transport capacity over longer distances than afforded by conventional heat pipes. For these applications, the basic heat pipe is typically enhanced by returning the liquid from the condenser portion to the evaporator portion in a separate liquid return line that does not have an internal wick. Because this return flow does not suffer the large pressure drop of flow through a wick, the distance between the evaporator and condenser can be substantially increased. In addition, the capillary wick within the evaporator is moved away from the heat-acquisition interface, typically by providing ribs that additionally define vapor passageways between the wick and heat-acquisition interface. These modifications lead to two types of conventional heat-transfer systems, namely, the loop heat pipe (LHP) and capillary pumped loop (CPL). CPLs and LHPs are increasingly being employed in spacecraft thermal management systems, and their operating characteristics, both on earth and in microgravity, have been studied extensively.

FIG. 1B illustrates an exemplary conventional evaporator suitable for use in either an LHP or CPL. Evaporator 20 includes a tubular housing 22 and a like-shaped capillary wick 24 located within the housing. Capillary wick 24 defines a central passageway 26 for conducting a liquid 28 along the length of the wick. Housing 22 is typically made of a highly conductive metal and includes a plurality of vapor manifold ribs 30. Ribs 30 serve the dual purposes of: (1) defining a plurality of vapor passageways, or channels 32, for conducting vapor 34 formed by vaporizing liquid 28 in a direction away from capillary wick 24 and (2) conducting heat from the outer portion of housing 22 to the capillary wick to transfer the heat to the liquid, thereby causing the liquid to vaporize.

The primary differences between conventional evaporators of CPLs and LHPs, such as evaporator 20 of FIG. 1B, and the evaporator portions of conventional heat pipes of FIG. 1A are that (1) in the LHP/CPL type evaporators the liquid supply is substantially thermally isolated from the heat source, e.g., by capillary wick 24, and (2) the liquid flow through the capillary wick is normal to the heat acquisition interface and, hence, the flow area is much larger and the flow length much shorter than in the "wall-wick" evaporator portion of a heat pipe. These differences result in substantially higher heat transport capacity for LHPs and CPLs than for heat pipes. However, the higher heat transport capacity in LHP/CPL type evaporators comes at a price, namely, a substantially degraded thermal connection between heat source 36 and capillary wick 24 caused by the non-continuous contact of housing 22 with the wick via ribs 30, which are typically made of metal.

The design of metal ribs 30 must meet the conflicting requirements of minimizing the thermal resistance between housing 22 and capillary wick 24, while at the same time minimizing the vapor pressure drop within evaporator 20. As shown in FIG. 1C, the presence of ribs 30 distorts the heat transfer and fluid flow in capillary wick 24 because they create hot zones within the wick. At low heat fluxes, capillary wick 24 is completely or fully wetted and evaporation takes place only in regions 33 at the surface of the wick adjacent the edges of the ribs 30 where the ribs contact the wick. The magnitude of heat transfer is limited by the perimeter length of the ribs that contact the wick. The total area of evaporation regions 33 in capillary wick 24 is therefore small and, hence, the evaporation resistance much increased. Additionally, instead of flowing uniformly through capillary wick 24, liquid 28 must now converge into narrow regions along ribs 30, greatly increasing the pressure drop in the wick.

FIG. 1D illustrates conditions that exist within the wick at larger values of heat flux. At higher heat fluxes, the liquid-vapor interface 40 recedes into capillary wick 24, providing a larger area for evaporation. As liquid-vapor interface 40 recedes, the thermal resistance of evaporator 20 increases because of the relatively low thermal conductivity of capillary wick 24. Perhaps more importantly, as liquid-vapor interface 40 recedes, the overall pressure drop increases sharply because vapor 34 must now flow some distance through the small pores of capillary wick 24 before reaching vapor grooves or channels 32. Eventually, the pressure drop in vapor 34 exceeds the capillary pumping capacity of capillary wick 24 and the vapor breaks through to central passageway 26, i.e., the liquid side of evaporator 20. This "vapor blow-by" condition sets the heat flux limit on evaporator performance.

To mitigate these effects, conventional LHP-type evaporators typically utilize metal capillary wicks instead of ceramic, glass, or polymer wicks to provide the wicks with a relatively high thermal conductivity. Higher thermal conductivity more effectively spreads heat into the wick, increasing the area over which evaporation takes place, thereby reducing thermal resistance. However, higher thermally conductive wicks increase the leakage of heat through the wick to liquid 28 at the other side of the wick. This can cause boiling of liquid 28 in the central passageway 26 thereby blocking the flow of liquid 28 to the evaporator and limiting the maximum heat flux. Increasing the thickness of the wicks will somewhat mitigate this heat leakage but will, in turn, decrease their permeability and, thus, also reduce the maximum heat flux of such evaporators.

It is anticipated that thermal management of future high-power laser instrumentation, next- and future-generation microprocessor chips, and other electronics, among other devices, will require power dissipation in the range of 2-5 kW at heat fluxes greater than 100 W/cm$^2$.

The ITANIUM® microprocessor from Intel Corporation, Santa Clara, Calif. is already reaching local heat fluxes of about 300 W/cm$^2$. In contrast, most conventional evaporators, such as evaporator 20 discussed above, typically do not work at heat-fluxes in excess of about 12 W/cm$^2$ because vapor blanketing in the capillary wicks blocks the flow of liquid into the wicks. Although some more recent evaporator designs, such as the bidispersed wick design, have demonstrated good performance at localized heat fluxes of 100 W/cm$^2$ there is, and will continue to be, a need for evaporators capable of routinely handling average heat fluxes of 100 W/cm$^2$ and greater.

SUMMARY

In accordance with the present invention, there is provided a heat transfer device for transferring heat to or from a fluid that is undergoing a phase change, the heat transfer device including a fractal structure, or bridge, for handling large heat fluxes, for example from about 100 W/cm$^2$ to about 1,000 W/cm$^2$ and greater. In one embodiment, the device includes a first bridge that is disposed between at least one first rib defining at least one first channel and a capillary wick that confronts, and is spaced from, the at least one first rib. The bridge provides fluid communication between the capillary wick and the at least one first channel and thermal communication between the capillary wick and the at least one rib. The bridge further includes a plurality of internal passageways each having a cross-sectional flow area that decrease in a direction from the at least one first rib to the capillary wick.

In another embodiment, the heat transfer device includes a capillary wick disposed between a first bridge and a second bridge. The first bridge may confront a first face of the capillary wick and may include a plurality of first internal passageways each having a first cross-sectional area. In this embodiment, the plurality of first internal passageways become less numerous in a direction away from the capillary wick and the cross-sectional areas of the plurality of first internal passageways become larger in a direction away from the capillary wick. A second bridge may confront a second face of the capillary wick, and may also include a plurality of second internal passageways each having a second cross-sectional area, wherein the plurality of second internal passageways become less numerous in a direction away from the capillary wick and the cross-sectional areas of the plurality of second internal passageways become larger in a direction away from the capillary wick.

In another embodiment, the heat transfer device includes a capillary structure, a heat interface, and a liquid-vapor manifold that transports both liquid and vapor. The liquid-vapor manifold may include one or more layers, each layer including one or more conduits and wherein adjacent layers have an increasing number of conduits with decreasing cross-sectional area when traveling in a first direction toward the capillary structure. Each layer of conduits is in fluid connection with adjacent layers and, as such, are designed to direct liquid between a liquid supply and the capillary structure. The conduits are further positioned to form a plurality of openings between the at least first layers and second layers, the plurality of openings being designed to distribute vapor in a second direction, away from the flow of the liquid. The direction of fluid and vapor flow is dependent upon whether the device is being used as an evaporator or a condenser. The liquid-vapor manifold may specifically have a fractal structure where the number of openings in each layer increases in a direction toward the capillary structure and their cross-sectional area decreases. The heat transfer device may be disposed in a housing in order to contain the vapor. In one embodiment, the capillary structure includes an array of grooves disposed in an inner surface of the heat transfer interface. In another embodiment, the capillary structure is a porous layer of highly thermal conductive material in thermal communication with the heat transfer interface.

As will be appreciated, the devices of the embodiments disclosed herein may be used as either an evaporator or a condenser, the difference between the two being primarily the direction of flow for the heat, liquid and/or vapor, as appropriate.

BRIEF DESCRIPTION OF THE DRAWINGS

It should be understood that the drawings are provided for the purpose of illustration only and are not intended to define the limits of the invention. The present invention is not limited to the precise arrangements and instrumentalities shown in the drawings, and the drawings are not necessarily to scale, emphasis instead being placed upon illustrating the principles disclosed herein.

DETAILED DESCRIPTION OF THE ILLUSTRATIVE EMBODIMENTS

Figure 2:
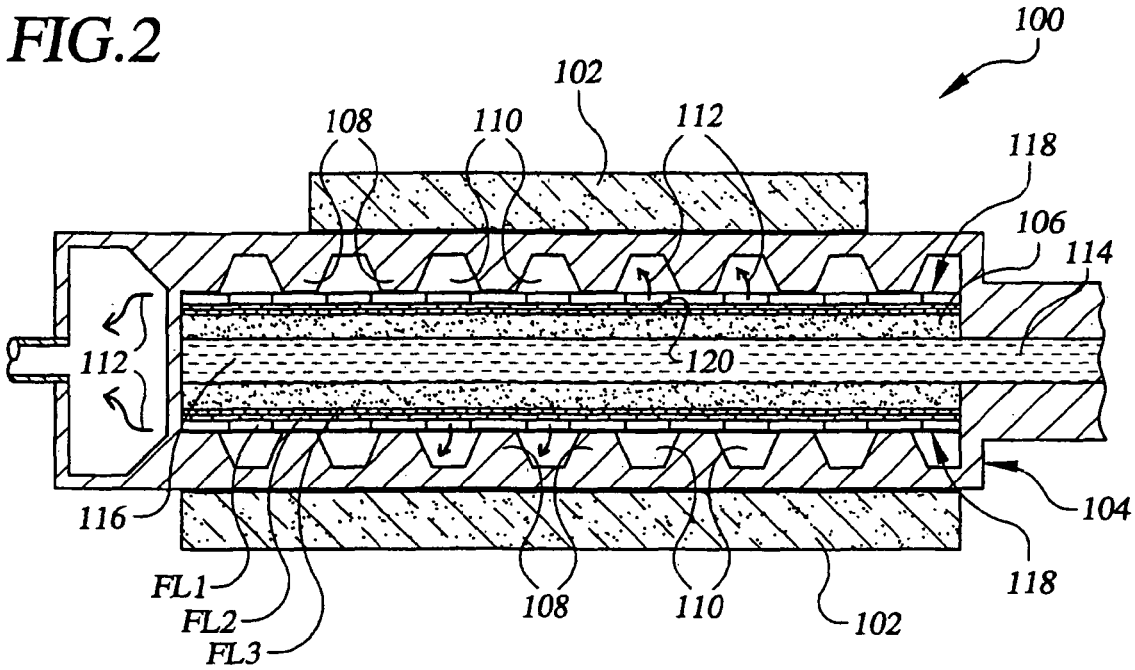
FIG. 2 is a cross-sectional view of a capillary evaporator of the present invention.

Referring now to the drawings, FIG. 2 illustrates a capillary heat exchanger which may be configured as an evaporator or condenser and which is identified generally by the numeral 100. For purposes of explanation, the following description will be in terms of a capillary evaporator, with the understanding that the description would also be applicable to a condenser. Like evaporator 20 discussed in the background section, above, capillary evaporator 100 may be incorporated into a two-phase heat-transfer system, such as the loop heat pipe (LHP) and capillary pumped loop (CPL) systems mentioned above, among others. Capillary evaporator 100 may be any size and/or shape suitable for interfacing with any of a variety of heat sources, such as heat source 102, that is desired to be cooled. Those skilled in the art will appreciate the variety of shapes and/or sizes of capillary evaporator 100 that may be made in accordance with the present invention and that the various capillary evaporators shown and described in the present application are generally provided only to illustrate the various aspects of the present invention and not to limit the scope of the invention, as defined by the claims appended hereto.

Due to its unique structure, which is described below in detail, capillary evaporator 100 of the present invention can be provided with the ability to handle large heat fluxes, e.g., 100 W/cm$^2$ to 1,000 W/cm$^2$ and greater, that are significantly higher than the maximum heat fluxes that conventional capillary wick type evaporators can handle. Therefore, capillary evaporator 100 can be an important component of heat-management systems for heat sources 102 having high heat fluxes, such as lasers, microprocessors, and other high-power electronic devices, among others, in both gravity and microgravity applications. Those skilled in the art will appreciate the variety of applications for which capillary evaporator 100 of the present invention may be adapted.

Similar to evaporator 20 described in the background section above, capillary evaporator 100 may comprise a housing 104 and a capillary wick 106 located within the housing. Housing 104 may be made of a material having a relatively high thermal conductivity, such as a metal, e.g., copper or aluminum, among others, or other high thermally conductive material, to conduct heat from heat source 102 toward capillary wick 106. Housing 104 may include a plurality of ribs 108 that define one or more vapor passageways, or channels 110, for conducting away from capillary wick 106 vapor 112 formed by the vaporization of a working liquid 114 at the wick due to the heat from heat source 102.

As used herein and in the appended claims, the plural term "ribs" includes the case wherein a single rib, e.g., a single spiral rib or a single meandering rib, is present, but a linear cross-section reveals that such single rib is "cut" at a plurality of locations along its length to give the illusion that a plurality of ribs is present. The term "ribs" also includes any structure that defines either of the lateral sides of a channel, whether or not a second channel is located on the other side of that structure. For example, the portions of a solid block of material that define the lateral sides of a sole channel formed in the block are considered ribs for the purposes of the present invention.

Capillary wick 106 may be made of any suitable material having capillary passageways for conducting working liquid 114 therethrough. For example, capillary wick 106 may be made of a material having a relatively low thermal conductivity, such as a ceramic, glass, or polymer, among others, or a material having a relatively high thermal conductivity, such as metal, among others. Such materials may be formed into capillary wick 106 by any known means, such as casting, sintering, micro-machining, and etching, among others. In addition to conventional wick structures, capillary wick 106 may also comprise one or more micro-porous fractal layers (not shown) similar to the fractal layers FL described below. Those skilled in the art will appreciate the variety of materials and structures that may be used for capillary wick 106. Capillary wick 106 may define a central passageway 116 for conducting liquid 114 along the length of the wick to distribute the liquid to the wick. Working liquid 114 may be any suitable liquid capable of providing capillary evaporator 100 with two-phase (liquid/vapor) operation under the conditions for which the capillary evaporator is designed to operate. Examples of liquids suitable for working liquid 114 include water, ammonia, alcohols, and refrigerants, such as R-134 fluorocarbon, among others.

Unlike evaporator 20, however, capillary evaporator 100 of the present invention includes a "thermal bridge," such as vapor-side bridge 118, interposed between ribs 108 and capillary wick 106. Generally, vapor-side bridge 118 functions as a heat spreader to spread heat from ribs 108 substantially uniformly across the outer surface 120 of capillary wick 106 and as a vapor collection manifold to conduct vapor 112 formed at the outer surface of the capillary wick to vapor passageways 110.

Figure 3:
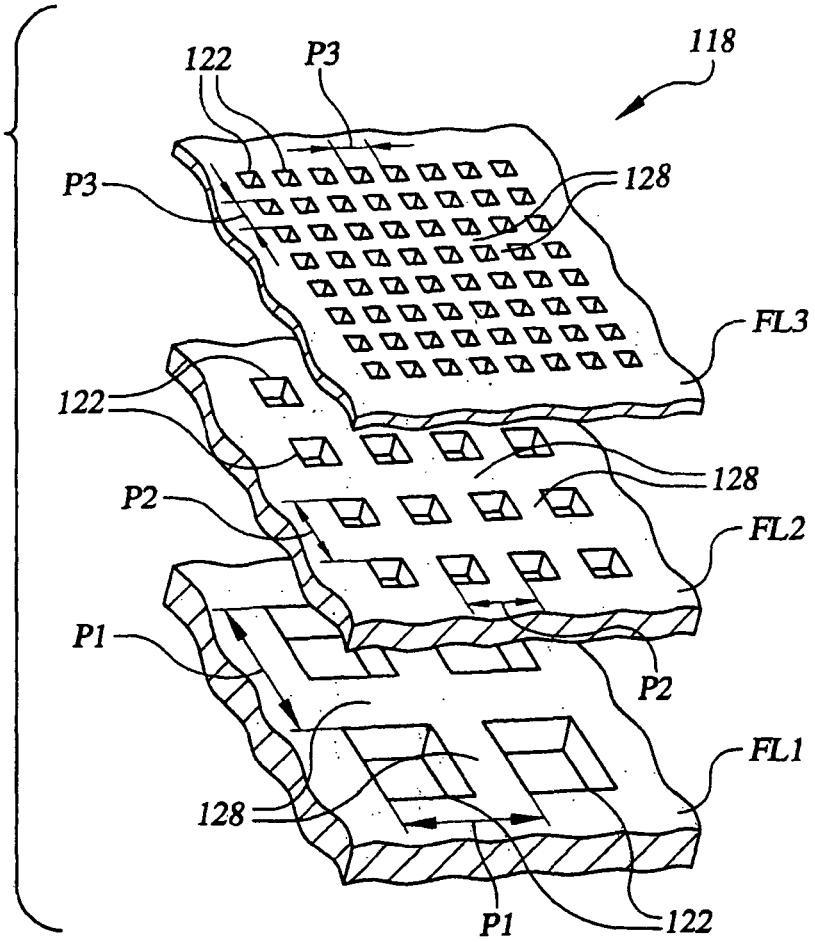
FIG. 3 is a perspective exploded view of a portion of the vapor-side bridge of the capillary evaporator of FIG. 2.
Figure 4:
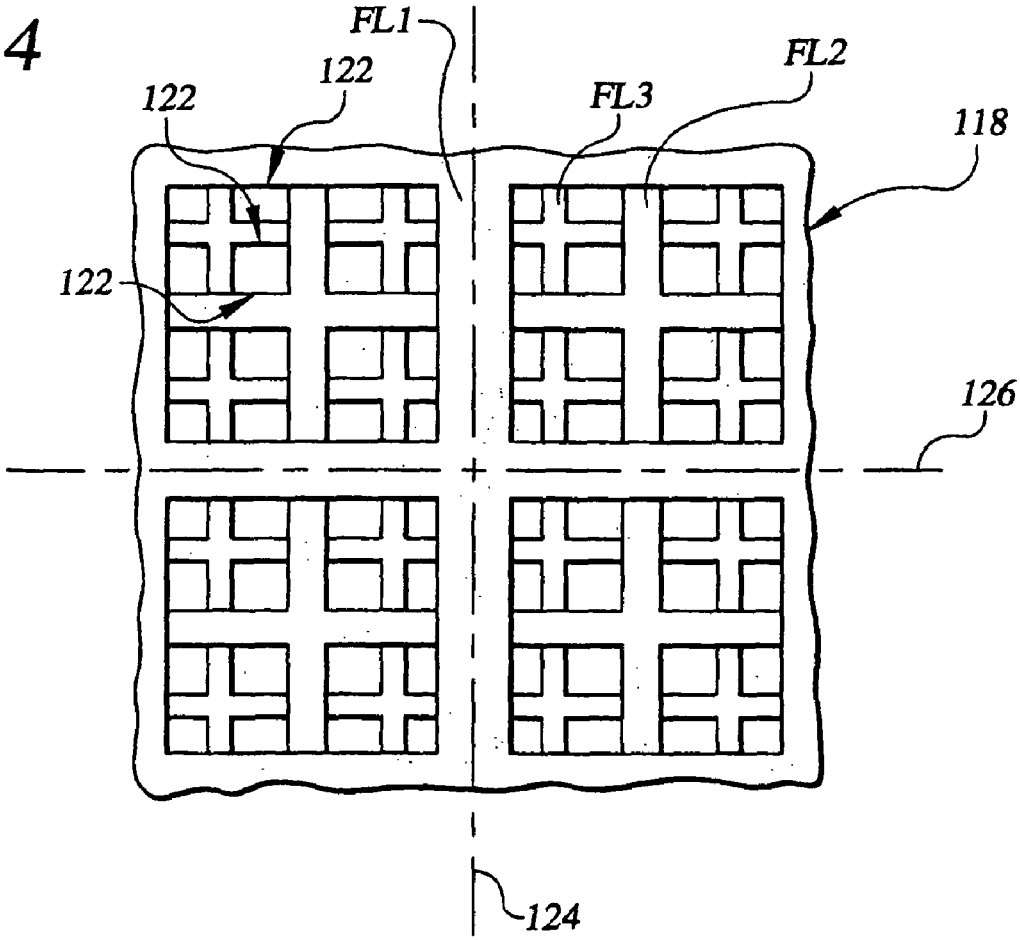
FIG. 4 is an enlarged partial plan view of the vapor-side bridge of FIG. 3.
Figure 5A:
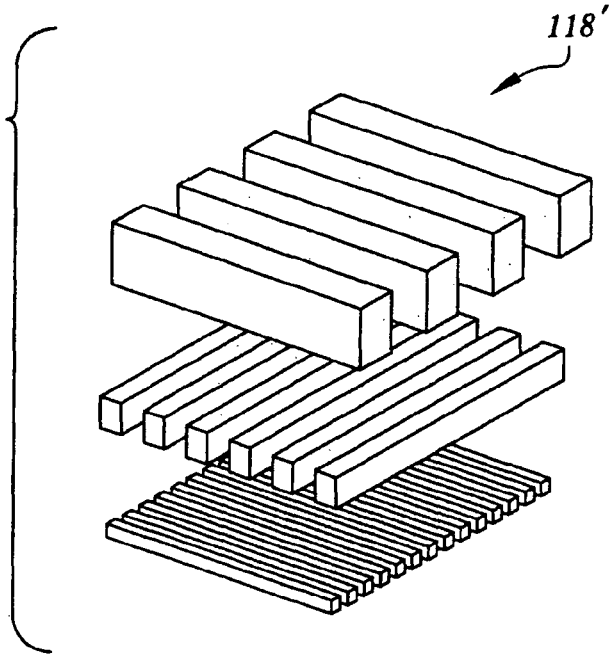
FIGS. 5A-5D are each a perspective exploded view of an alternative embodiment of the vapor-side bridge of the capillary evaporator of FIG. 2.
Figure 5B:
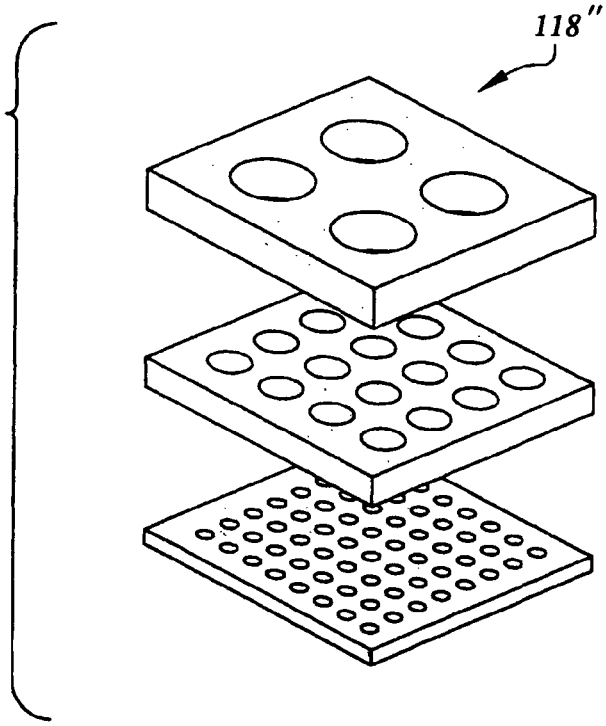
Figure 5C:
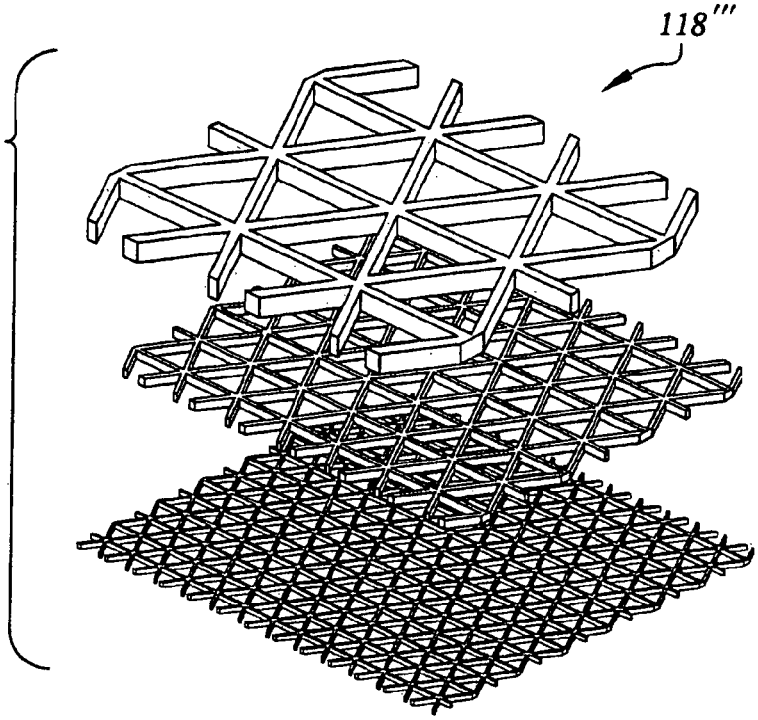
Figure 5D:
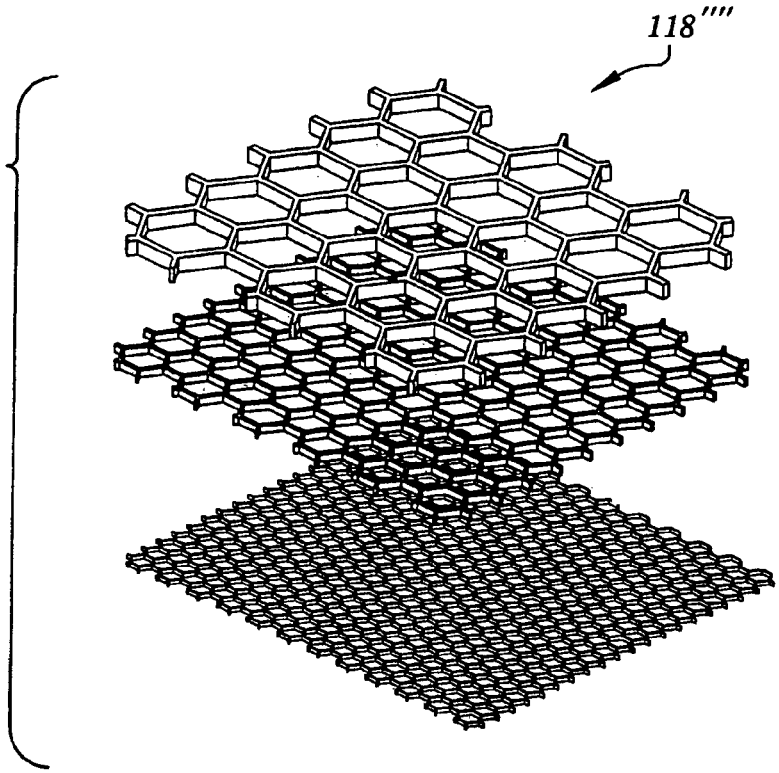

Referring to FIGS. 3 and 4, and also to FIG. 2, vapor-side bridge 118 may include one or more "fractal" layers FL, such as fractal layers FL1, FL2, FL3 shown. As used herein, the term "fractal" is used to indicate that the various layers FL have a geometric pattern that is repeated at different scales between the layers. In the present embodiment, bridge 118 has an internal structure generally defined by openings 122 configured and arranged so as to provide the bridge with the ability to spread heat from ribs 108 as evenly as practicable over outer surface 120 of capillary wick 106, while also providing the bridge with a high permeability to vapor 112. One type of bridge 118 that satisfies these competing criteria comprises a plurality of layers FL each having openings 122 in sizes and of a number different from the sizes and numbers of the openings of the other layers FL, with the layer(s) more proximate ribs 108 having larger and fewer openings and the layer(s) more proximate outer surface 120 of capillary wick 106 having smaller and more openings.

When openings 122 in all of layers FL are the same shape as one another and are arranged in the same pattern, but the sizes of the openings decrease from layer to layer while the number of the openings increases, the openings are somewhat "fractal" in nature, i.e., their shapes and patterns are repeated at increasingly smaller scales from one layer to the next in a direction away from ribs 108. It is noted, however, that the use of the term "fractal" herein is not intended to imply that the shapes and patterns must be the same from one layer FL to the next layer, nor that there be any formal mathematical relationship among the scale factors between adjacent layers, if more than two layers are used. In addition, it is noted that although bridge 118 is shown and described as including a plurality of layers FL that are separate sheets, the layers may be present within a monolithic bridge. Furthermore, in the latter case, layers FL may not be as well defined as they are in a sheet-type embodiment. That is, the transition from larger and fewer openings 122 proximate ribs 108 to smaller and more openings proximate outer surface 120 of wick 106 may be more gradual than the discrete steps that the individual sheets provide. Those skilled in the art will appreciate that although FIGS. 2-4 illustrate vapor-side bridge 118 as having three fractal layers FL1-3, a bridge of the present invention may have more or fewer than three fractal layers depending upon the design of the particular capillary evaporator 100.

Each fractal layer FL1-3 may be formed from a sheet of metal, such as copper or aluminum, or other material having a relatively high thermal conductivity and comprises a plurality of passageways, or openings 122, extending through the sheet. Openings 122 in fractal layers FL1-3 may be provided in increasing numbers and decreasing sizes in each successive layer the closer that layer is to capillary wick 106. That is, fractal layer FL1 farthest from capillary wick 106 may have relatively few large openings 122, whereas fractal layer FL3 closest to the wick has relatively many small openings 122. Fractal layer FL2 would then have an intermediate number of intermediate sized openings 122.

Figure 1A:
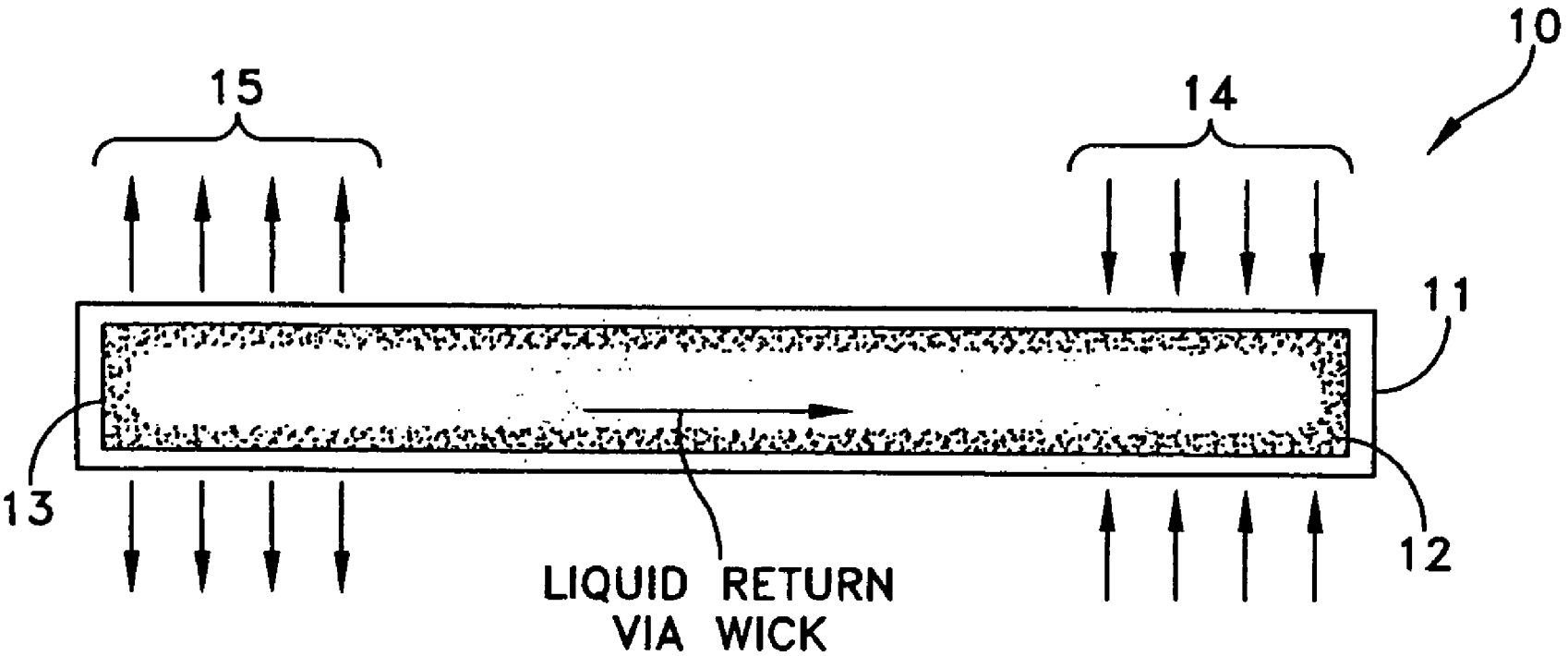
FIG. 1A (PRIOR ART)
FIG. 1A is a schematic, cross-sectional view of a conventional prior art capillary evaporator heat pipe.
Figure 1B:
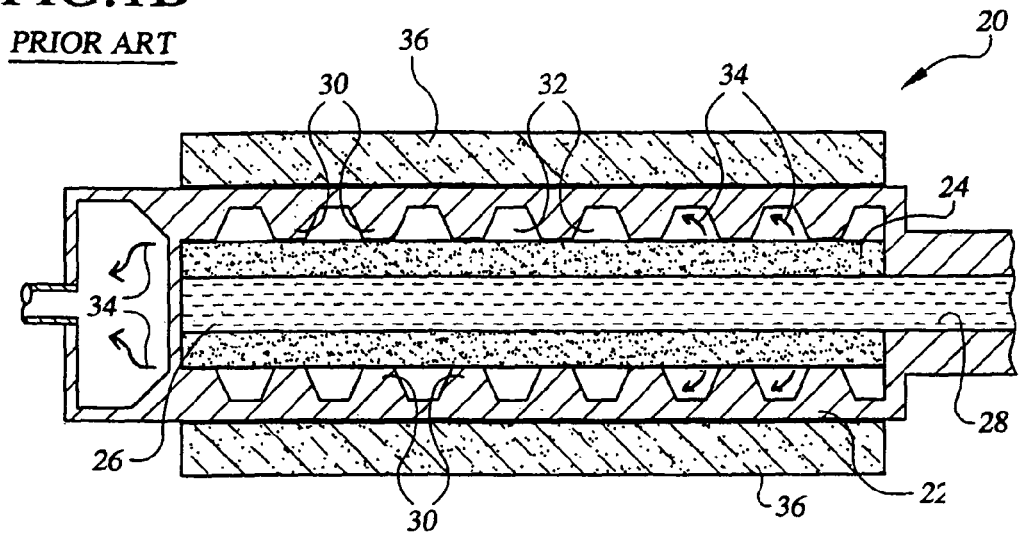
FIG. 1B PRIOR ART
FIG. 1B is a longitudinal cross-sectional view of a conventional capillary pumped loop or loop heat pipe evaporator.
Figure 1C:
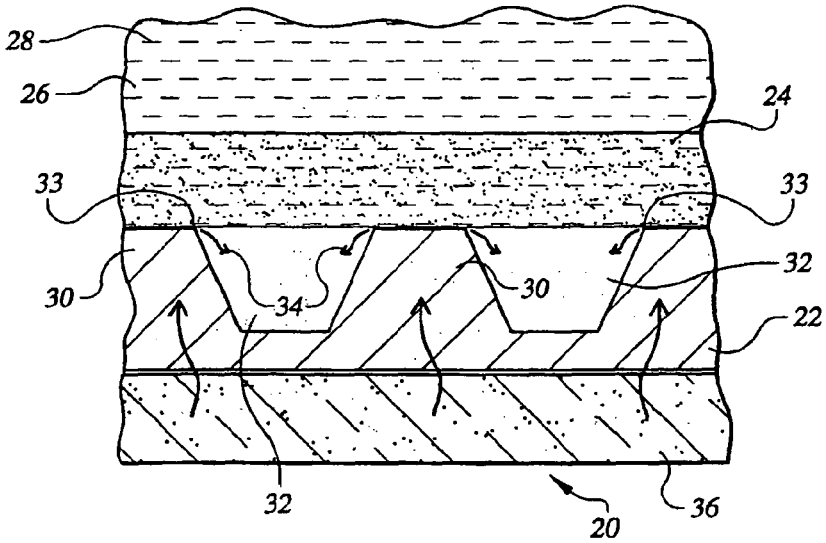
FIG. 1C PRIOR ART
FIGS. 1C and 1D are enlarged cross-sectional views of the capillary wick/housing interface of the conventional capillary evaporator of FIG. 1D showing, respectively, the capillary evaporator under low and high heat-flux conditions.
Figure 1D:
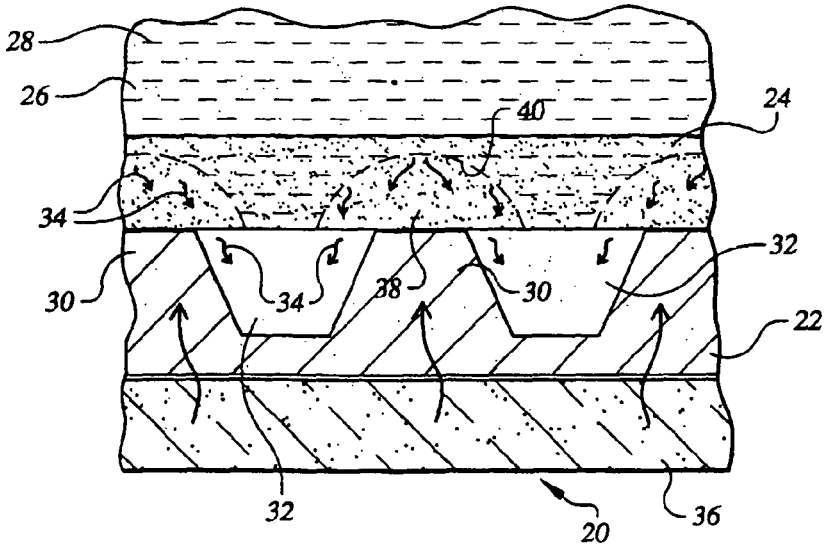
FIG. 1D PRIOR ART

The configuration of fractal layers FL and arrangement of openings 122 therein provides several important advantages compared to prior art evaporator structures. As the feature size of the fractal layers FL decreases, the contact perimeter between wick 106 and bridge 118 increases many times beyond the contact perimeter between ribs 30 and wick 24 shown in FIG. 1B. Therefore, the region of evaporation is increased significantly and levels of heat-flux may be increased to values that would produce vapor penetration within prior art wicks, e.g., wick 24 as illustrated in FIG. 1D. Further, vapor-side bridge 118 is an efficient structure for creating a compromise for the competing requirements that the bridge must satisfy, conducting heat from housing 104 to capillary wick 106 and providing passageways, formed by the overlap of openings 122 in the various fractal layers FL1-3, for conducting vapor 112 away from the wick. Also, because the flow of heat is more effectively spread to all regions of wick 106 and not concentrated at locally confined regions as is so in conventional evaporators, e.g., in evaporator 20 of FIG. 1B wherein ribs 30 are in direct contact with wick 24, the material of capillary wick 106 may be thermally insulating, rather than thermally conducting, without suffering appreciable performance penalty. In this case, heat transfer to the opposite side of capillary wick 106 adjacent to liquid 114 is much decreased, and the performance limit whereby bubble boiling occurs in the liquid is eliminated.

In one particular configuration, fractal layer FL1 may be provided with square openings 122 having a pitch P1, i.e., distance from one point of an opening to the same point of an immediately adjacent opening, wherein each opening in fractal layer FL1 has a first area A1. It is noted that in the embodiment shown, pitch P1 is the pitch along two orthogonal axes 124, 126 of vapor-side bridge 118. Those skilled in the art will appreciate, however, that pitch P1 along each of axes 124, 126 (FIG. 4) may be different from one another. In addition, pitch P1 may also vary in any direction to optimize vapor-side bridge 118 for particular design conditions. If desired, pitch P1 may be equal to the pitch of ribs 108 so that webs 128 of fractal layer FL1 may confront corresponding ribs to maximize the size of the contact area between fractal layer FL1 and the ribs to maximize the conduction between the ribs and fractal layer FL1.

The size and pitch of openings 122 in each successive fractal layer FL beneath fractal layer FL1, i.e., fractal layers FL2 and FL3, respectively in the present example, may be scaled by a scale factor of less than one with respect to the immediately preceding fractal layer. For example, when the scale factor is 0.5, pitch P2 of openings 122 in fractal layer FL2 along orthogonal axes 124, 126 would be equal to one-half of pitch P1 and the lengths of the sides of the square openings would be equal to one-half the lengths of the sides of the openings in fractal layer FL1. Accordingly, fractal layer FL2 would have four times the number of openings 122 as fractal layer FL1 and twice the total perimeter length of the openings, but the total area of the openings would be the same. Similarly, fractal layer FL3 may be scaled by a factor of 0.5 with respect to fractal layer FL2, such that pitch P3 would be one-half of pitch P2 such that fractal layer FL3 would have four times the number of openings 122 as fractal layer FL2, with twice the total perimeter, but, again, the same total opening area. In addition to varying the number, pitch P1-3, and size of openings 122 from one fractal layer FL1-3 to another, the thickness of these fractal layers may also, but need not necessarily, be scaled. For example, with a scale factor of 0.5, the thickness of fractal layer FL2 may be equal to one-half the thickness of fractal layer FL1, and the thickness of fractal layer FL3 may be equal to one-half the thickness of fractal layer FL2. The following Table I illustrates the relationship between various aspects of fractal layers FL1-3 for a scale factor of 0.5 for each pair of adjacent layers.

TABLE I

| Fractal Layer | Gross Area ($cm^2$) | Number of Openings | Area of each Opening ($\mu m^2$) | Total Perimeter of Openings ($\mu m^2$) | Pitch ($\mu m$) | Thickness ($\mu m$) |
|---|---|---|---|---|---|---|
| FL1 | 4 | 289 | $4.9 \times 10^5$ | $8.092 \times 10^5$ | 1,200 | 500 |
| FL2 | 4 | 1,156 | $1.225 \times 10^5$ | $16.184 \times 10^5$ | 600 | 250 |
| FL3 | 4 | 4,624 | $3.0625 \times 10^4$ | $32.368 \times 10^5$ | 300 | 125 |

Vapor-side bridge 118, and therefore fractal layers FL1-3 may be made in any shape needed to conform to the shape of outer surface 120 of capillary wick 106. For example, if capillary wick 106 is planar, fractal layers FL1-3 may likewise be planar, and if the wick is cylindrical, the fractal layers may likewise be cylindrical. If vapor-side bridge 118 is a shape other than planar, such as curved or folded, pitches P1-3 of openings 122 in fractal layers FL1-3 may need to be different from the pitches that would be used for a corresponding planar bridge 106 to account for the effect of the curvature or fold and the fractal layers being different distances from the center of curvature or fold.

To improve the conduction of heat through vapor-side bridge 118, and/or create a unified structure for the bridge, fractal layers FL1-3 may, but need not necessarily, be bonded or otherwise continuously attached to one another at the regions of contact between adjacent layers, e.g., by diffusion bonding. Similarly, to improve the thermal conductance between ribs 108 and vapor side bridge 118 and/or between the bridge and capillary wick 106, the bridge may likewise be attached to one or both of the ribs and wick, e.g., by diffusion bonding or other means.

Each fractal layer FL1-3 may be fabricated using any one or more fabrication techniques known in the art to be suitable for creating openings 122 and other features of these layers. Such techniques may include the masking, patterning, and chemical etching techniques well known in the microelectronics industry and micro-machining techniques, such as mechanical machining, laser machining, and electrical discharge machining (EDM), among others, that are also well known in various industries. Since these techniques for fabricating fractal layers FL1-3 are well known in the art, they need not be described in any detail herein. Although vapor-side bridge 118 is shown in FIGS. 3 and 4 as having square openings 122, as shown in FIGS. 5A-D alternative bridges 118', 118", 118'", 118'", respectively, may have openings that are any shape desired, such as elongate rectangular (FIG. 5A), circular (FIG. 5B), triangular (FIG. 5C), or hexagonal (FIG. 5D), among others.

As can be appreciated, the geometry of vapor-side bridge 118 is extremely rich and, therefore, can be readily adapted to optimize the bridge to a particular set of operating conditions of capillary evaporator 100. This is so because vapor-side bridge 118 has associated therewith a relatively large number of variables that a designer may change in optimizing a particular design. These variables include the number of fractal layers FL, thickness of each fractal layer, sizes of openings 122, shape of each opening, pitch P of the openings, scale factor, and ratio of open area to total area, among others.

Figure 6:
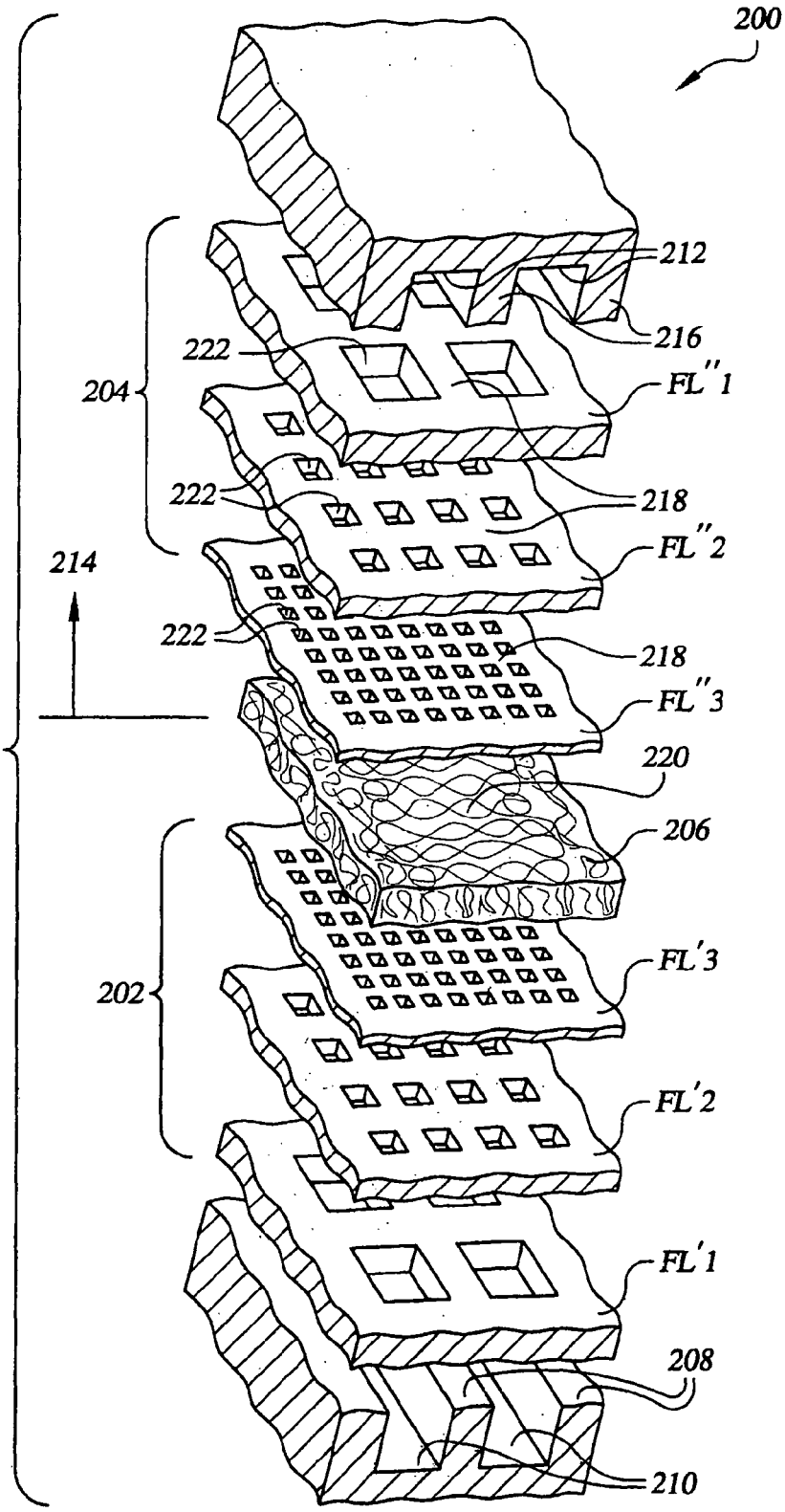
FIG. 6 is a perspective exploded partial view of a portion of an alternative capillary evaporator of the present invention having vapor-side and liquid-side bridges.

FIG. 6 illustrates an alternative capillary evaporator 200 of the present invention having both a vapor-side bridge 202 and a liquid-side bridge 204. Similar to vapor-side bridge 118 in connection with FIGS. 2-4 discussed above, vapor-side bridge 202 provides a robust structure for providing a structure between capillary wick 206 and vapor-side ribs 208 and vapor channels 210 that has great ability to spread heat from ribs to the wick, but also has a high permeability to allow vapor (not shown) to flow from the wick to the vapor channels. In the embodiment shown, vapor-side bridge 202 has three fractal layers FL'1-FL'3 similar to fractal layers FL1-3 described above with respect to bridge 118 of FIGS. 2-4. Of course, as discussed above, bridge 202 may have any number of fractal layers FL' desired and may have any structure suitable for providing a compromise to the competing criteria of high permeability and high heat spreading capability.

Liquid-side bridge 204 provides advantages similar to vapor-side bridge 202. That is, liquid-side bridge 204 provides a structure that substantially uniformly cools capillary wick 206 while providing a highly permeable structure that allows liquid (not shown) from liquid channels 212 to flow substantially uniformly across the wick. Cooling of capillary wick 206 is often desired so as to inhibit boiling of the liquid on liquid side 214 of capillary evaporator 200, a condition that is highly destructive to the cooling capabilities of the capillary evaporator. When liquid-side bridge 204 is made of a material having a high thermal conductivity, such as metal, among others, the liquid-side bridge provides this cooling capability, in part, by virtue of the fact that the region of the liquid-side bridge most distal from capillary wick 206 may contact the relatively cool ribs 216, which are cooled by the flow of the cool liquid flowing through liquid channels 212, e.g., from a condenser (not shown). This region of liquid-side bridge 204 is also immersed in the relatively cool liquid flowing from liquid channels 212. Thus, when liquid-side bridge 204 is thermally conductive, the solid portions 218 of layers FL"1-FL"3 "spread the coolness" from ribs 216 and the liquid in liquid channels 212 over the liquid-side surface 220 of capillary wick 206.

Like vapor-side bridges 202, 118 (FIGS. 2-4), liquid-side bridge 204 provides this spreading capability by virtue of its internal features, e.g., openings 222, decreasing in size while increasing in number from one layer FL" to the next in a direction away from ribs 216. It is this same structure that provides liquid-side bridge 204 with its relatively high permeability and ability to spread the liquid from liquid channels 212 across the liquid-side surface 220 of capillary wick 206. Similar to vapor-side bridge 202, while liquid side bridge is shown as comprising three fractal layers FL"1-FL"3, those skilled in the art will readily appreciate that liquid-side bridge may, too, have more or fewer layers and may have any structure suitable for providing high-permeability, high liquid spreadability, and high "coolness spreadability."

EXPERIMENTAL RESULTS

To illustrate the effect of the bridge of the present invention on the performance of a capillary evaporator of the present invention, the inventor fabricated four evaporators that were identical to one another, except for the number of fractal layers. One of the evaporators had no bridge whatsoever, and the other three evaporators each had both a vapor-side bridge and a liquid-side bridge, both of which had 1, 2, or 3 fractal layers each. These four evaporators are designated Fractal 0, Fractal 1, Fractal 2, and Fractal 3, which indicate the number of fractal layers in each of vapor-side and liquid-side bridges of that evaporator, if any.

Figure 7:
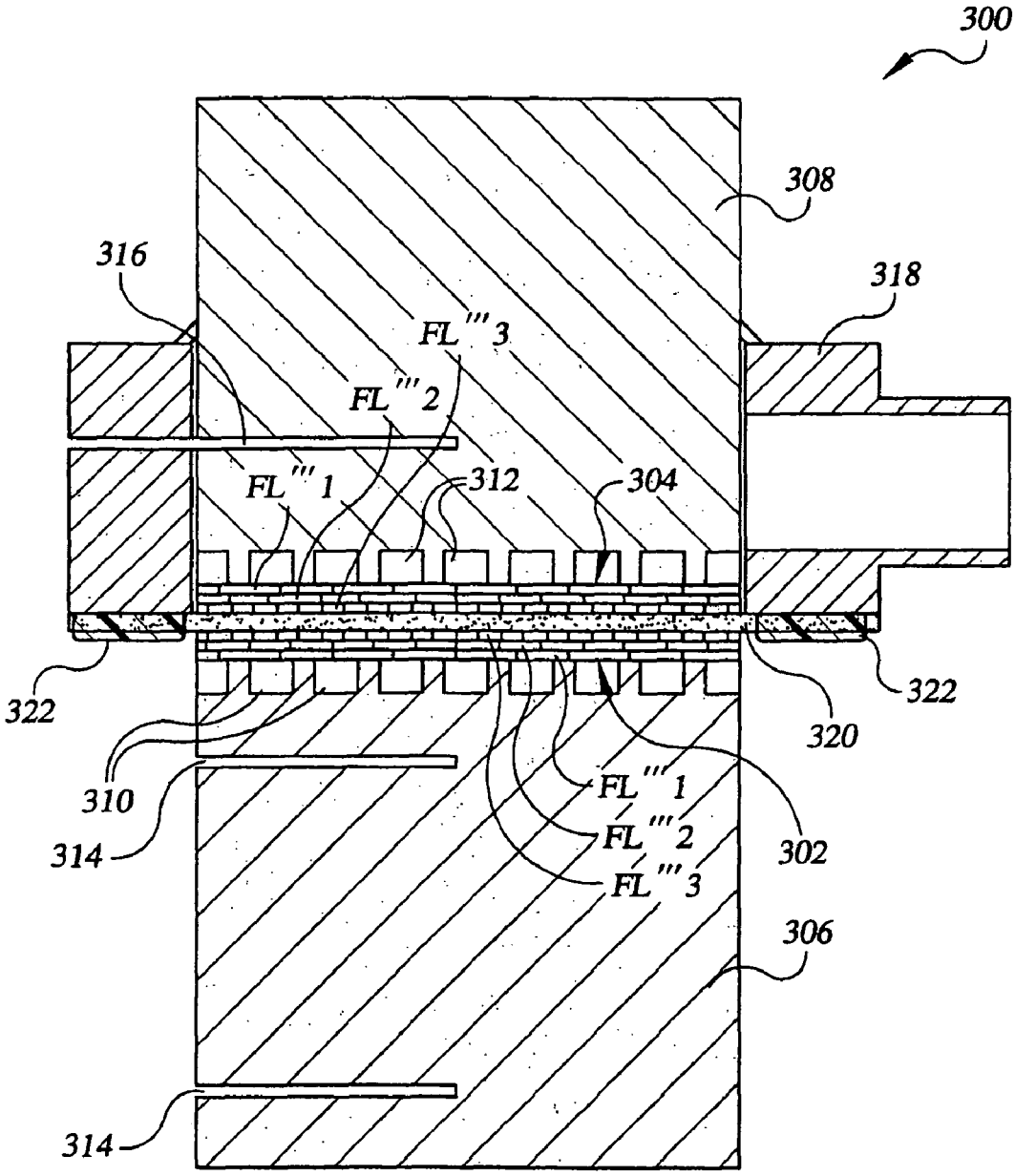
FIG. 7 is an elevational cross-sectional view of one of four test evaporators used to conduct experiments to quantify operating performance of various capillary evaporators made in accordance with the present invention.

FIG. 7 shows one of these four evaporators, which are generically referred to as evaporator 300 in the following discussion, i.e., the Fractal 3 evaporator that has all three fractal layers FL'''1-FL'''3 in each of its vapor-side and liquid-side bridges 302, 304. Fractal 2 evaporator (not shown) included only fractal layers FL'''2 and FL'''1 in each of its vapor-side and liquid-side bridges, and Fractal 1 evaporator (not shown) included only fractal layer FL'''1 in each of its vapor-side and liquid-side bridges. Fractal 0 evaporator (not shown) included no fractal layers and had only the wick 320 separating the liquid and vapor sides of the evaporator. Each fractal layer FL'''1-FL'''3 was photoetched out of a copper sheet, and where two or more fractal layers were present, they were diffusion bonded together. Tables II and III show the nominal and actual pitches, thickness, and area of openings for each of the three fractal layers. The pitch and thickness scale by a factor of 0.5, but due to variations in the etching process, the dimensions of opening are not quite to scale. It is noted that no attempt was made to optimize fractal layers FL'''1-FL'''3. Even so, the results obtained well-illustrate the benefits of bridges 302, 304 provided by their robust, unique structure.

TABLE II

| Fractal Layer | Opening Diameter (μm) | Pitch (μm) | Thickness (μm) |
|---|---|---|---|
| FL'''1 | 700 | 1,200 | 500 |
| FL'''2 | 350 | 600 | 250 |
| FL'''3 | 175 | 300 | 125 |

TABLE III

| Fractal Layer | Opening Diameter (μm) | Pitch (μm) | Thickness (μm) |
|---|---|---|---|
| FL'''1 | 632 | 1,199 | 508 |
| FL'''2 | 308 | 600 | 254 |
| FL'''3 | 221 | 300 | 125 |

Each bridge 302, 304, where present, was diffusion bonded to a corresponding relatively thick copper slug 306, 308 having either vapor manifold channels 310 or liquid manifold channels 312 machined into it. Vapor-side and liquid-side copper slugs 306, 308 also had machined therein two thermocouple ports 314 and one thermocouple port 316, respectively. The vapor-side and liquid-side assemblies each had a transverse cross-sectional area of 1 $cm^2$. Liquid-side slug 308 was soldered to a sleeve/fitting assembly 318 for supplying liquid manifold channels 312 with the working liquid. A 275 μm thick glass fiber capillary wick 320 having a capillary head of 1 m of water was bonded to sleeve/fitting assembly 318 with an epoxy 322.

It is noted that glass fiber capillary wick 320 was flexible but well supported on both of its planar faces by bridges 302, 304. As should be readily apparent, the continuity of the support from bridges 302, 304 becomes greater with the increasing number of fractal layers FL''', which translates into a smaller pitch for the openings in the fractal layers immediately adjacent to capillary wick 320, in the present case fractal layers FL'''3 of the two bridges.

Figure 8:
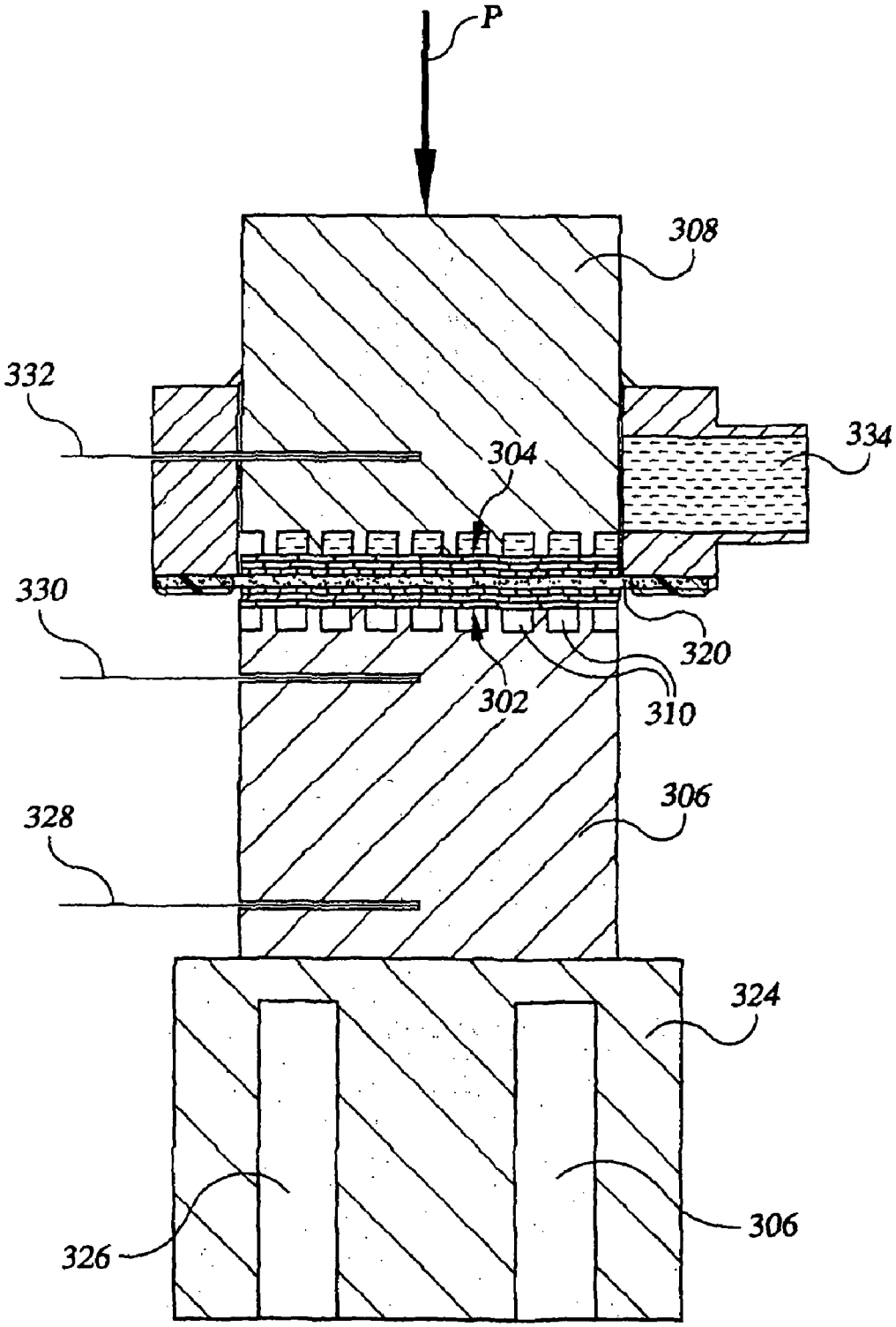
FIG. 8 is an elevational cross-sectional view of the test evaporator of FIG. 7 mounted in a testing apparatus.

As illustrated by FIG. 8, each vapor-side slug 306 was soldered to a corresponding large copper block 324 containing four 200 W cartridge heaters 326. The liquid-side assembly was then placed over the vapor-side assembly and held tightly thereagainst by applying a vertical load P to liquid-side slug 308. Care was taken to maintain alignment between the vapor- and liquid-side bridges 302, 304 during testing.

Three thermocouples 328, 330, 332 were used to measure various temperatures of the evaporators 300 during the tests. Thermocouples 328, 330 were placed on the vapor side to calculate the heat flux into evaporator 300. The temperature of vapor-side copper block 306 1 mm below the base of vapor manifold channels 310 was then obtained by subtracting from the upper thermocouple 330 temperature the calculated conduction temperature drop. The difference between the temperature 1 mm below the base of vapor manifold channels 310 and the vapor saturation temperature was used to calculate the thermal resistance of evaporator 300.

Room temperature, degassed water 334 was supplied to the liquid side of the evaporator from a 0.5 L flask (not shown). An air ejector (not shown) maintained a constant suction on the flask of 10 cm $H_2O$ throughout the tests. The flask was placed on an electronic scale (not shown) to allow real-time recording of its weight during the test. The water consumption rate was used to provide a verification of the heat flux measurement obtained from the thermocouple readings. The data from all the instruments (not shown) was recorded using a computer-based data acquisition system.

Figure 9A:
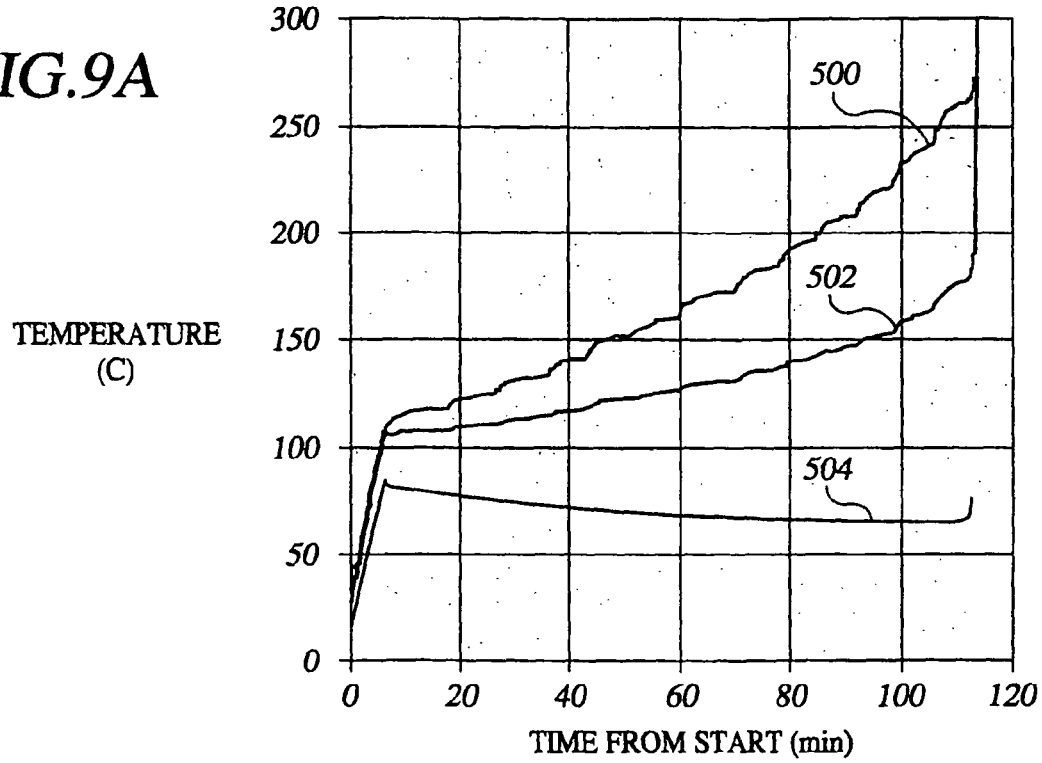
FIGS. 9A and 9B show, respectively, a typical temperature versus time trace for one of the test evaporators and the corresponding curve of thermal resistance versus heat flux.
Figure 9B:
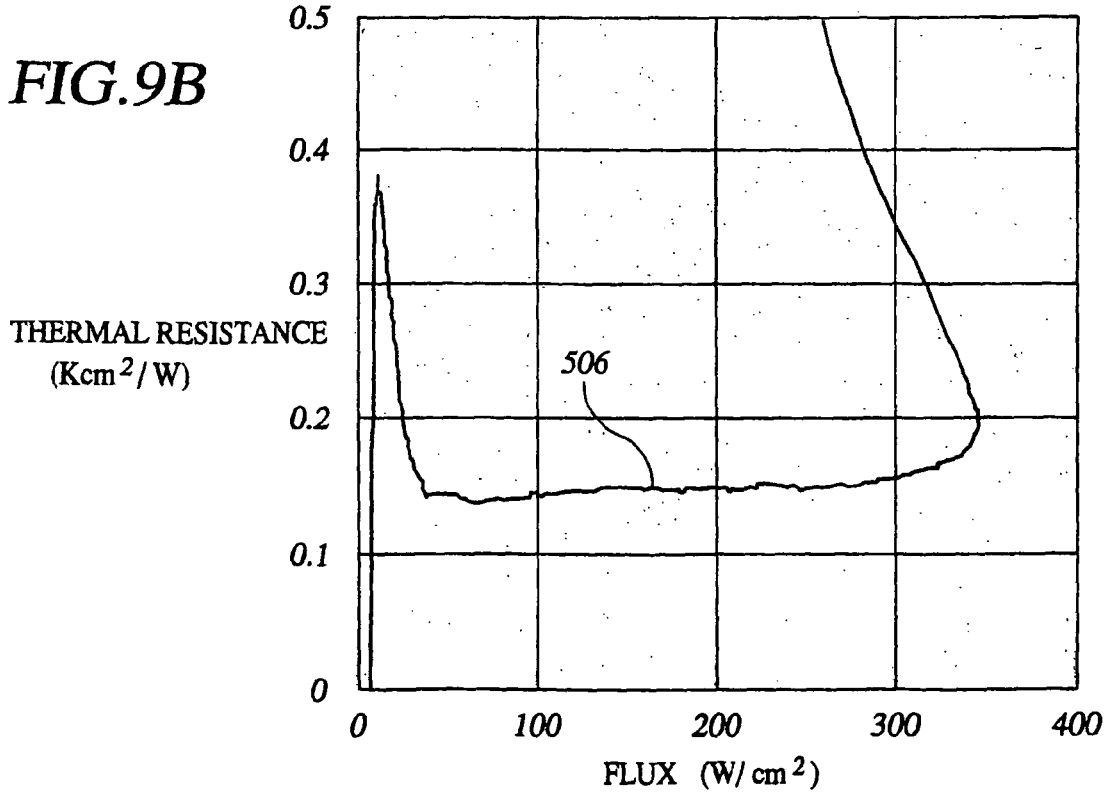
Figure 10A:
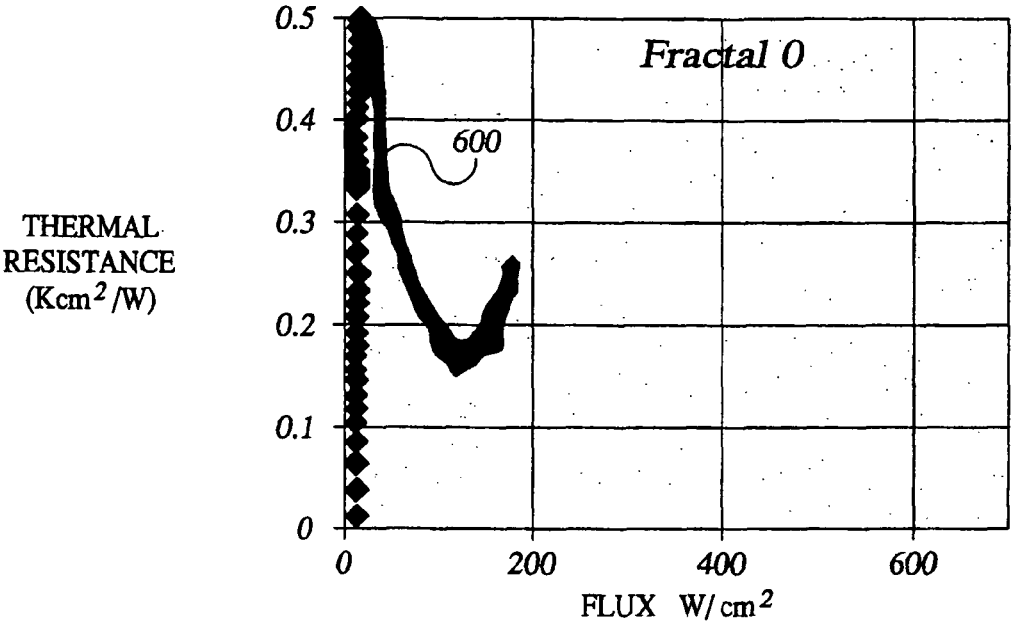
FIGS. 10A-10D are graphs of thermal resistance versus heat flux for, respectively, each of four test evaporators.
Figure 10B:
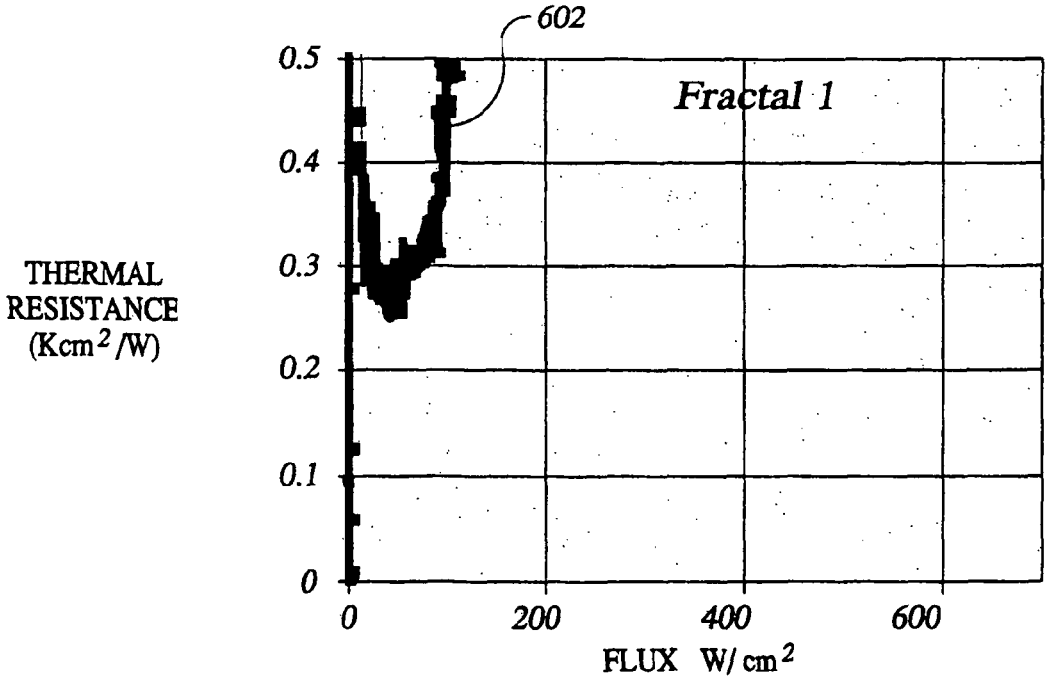
Figure 10C:
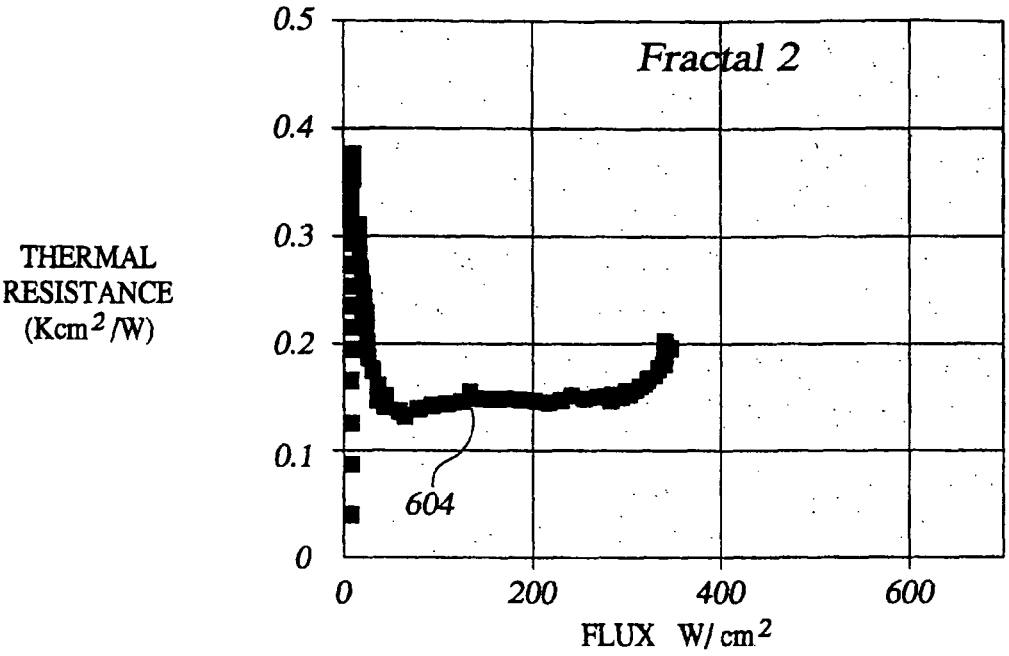
Figure 10D:
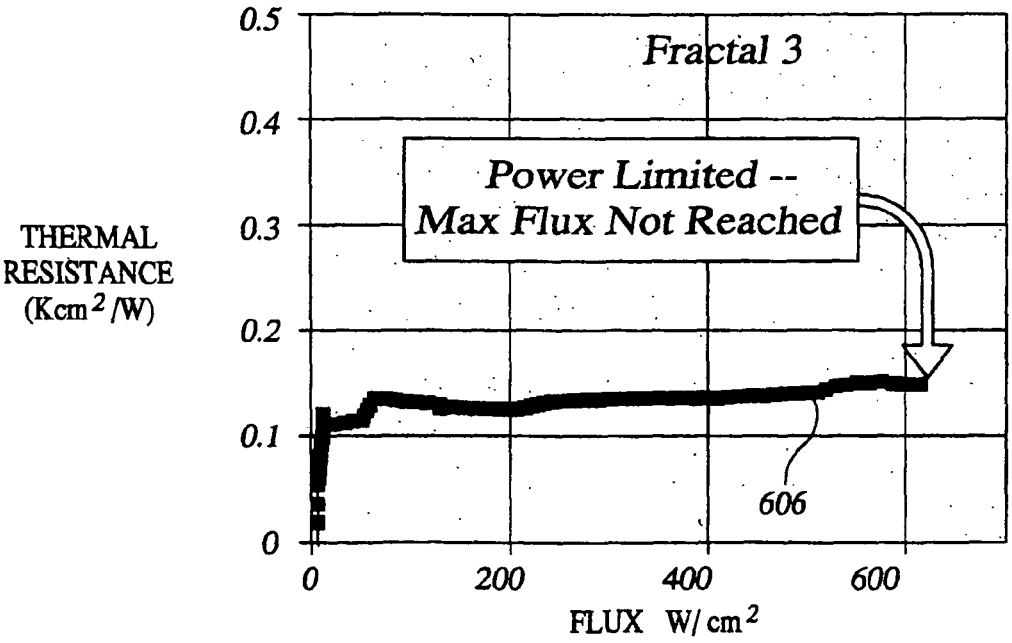

Referring to FIGS. 9A and 9B, and also to FIGS. 7 and 8, FIGS. 9A and 9B show, respectively, typical temperature traces 500, 502, 504 for thermocouples 328, 330, 332, respectively, and a corresponding thermal resistance versus heat flux curve 506 obtained during the tests. These results shown are for the Fractal 2 evaporator 300 having two fractal layers (FL'''1, FL'''2) in each of its vapor-side and liquid-side bridges 302, 304. Since the area of evaporator 300 was 1 $cm^2$ the heat flux also represents the actual heat input to the evaporator. As shown by FIG. 9A, at the beginning of the test all thermocouples 328, 330, 332 were at room temperature. As heat was applied, temperature traces 500, 502, 503 showed all three thermocouples 328, 330, 332 heated up rapidly. Vapor-side thermocouples 328, 330, i.e., traces 500, 502, showed little difference in temperature, but liquid-side thermocouple 332, trace 504, lagged behind because heat had to be conducted through low thermally conductive capillary wick 320 to heat up the liquid side of evaporator 300. When the temperature at the top of vapor-side bridge 302 reached the saturation temperature, evaporation started taking place and the temperatures of vapor-side thermocouples 328, 330 started to diverge, indicating heat was being absorbed by the evaporation of liquid 334 within evaporator 300. Temperature traces 500, 502 showed that the vapor-side temperatures continued to increase as the heat flux was gradually increased, until dryout point of capillary wick 320 was reached. Temperature trace 504 showed that the liquid-side temperature reached a maximum of about 90° C. during startup and then decreased as the increased heat flux caused an increased flow of room-temperature liquid into evaporator 300.

FIG. 9B shows the calculated thermal resistance curve 506 for evaporator 300 as a function of heat flux for the same test of the Fractal 2 evaporator 300. Curve 506 was produced real-time as the test progressed. After an initial start-up transient, the thermal resistance settled 2 to about 0.14 K/(W/$cm^2$) and remained fairly constant up to a heat flux of about 300 W/$cm^2$. This is an indication that up to that extremely high value of heat flux, the Fractal 2 evaporator 300 was operating with capillary wick 320 fully-wetted. As the heat flux approached 350 W/cm$^2$, the thermal resistance increased rapidly, indicating incipient dryout of capillary wick 320. Following dryout, evaporator 300 lost its ability to transport liquid 330 into the wick, heat absorption by evaporation of the liquid cannot take place, and the temperatures within the evaporator increased rapidly.

Referring now to FIGS. 10A-D, and also to FIGS. 7 and 8, FIGS. 10A-D are thermal resistance vs. heat flux curves 600, 602, 604, 606 for the Fractal 0, Fractal 1, Fractal 2, and Fractal 3 evaporators 300, respectively. These results show that a capillary evaporator of the present invention has a remarkable maximum heat flux capability. For example, toward the end of the tests for Fractal 3 evaporator 300, as indicated by curve 606 in FIG. 10D, cartridge heaters 326 were operating at full power, and the copper structure 324 where the cartridge heaters were installed glowed red-hot under its mineral wool insulation. Yet, cartridge heaters 326 did not have sufficient power to cause the Fractal 3 evaporator 300 to dry out. The test ended when all water in the flask that supplied water 334 to the capillary evaporator was consumed. Even Fractal 1 evaporator 300, which had the lowest opening perimeter per unit area, withstood a maximum heat flux in excess of 100 W/cm$^2$. It is noted that these are not just localized hot spots, but rather average heat fluxes over the entire cross-sectional area of evaporator 300.

It is noted that Fractal 0 evaporator 300, i.e., the test evaporator without vapor-side and liquid-side bridges 302, 304, performed slightly better than the Fractal 1 evaporator that had one bridge. Generally this is so because fractal layer FL'''1 of Fractal 1 evaporator 300 had a perimeter-to-area ratio smaller than the perimeter-to-area ratio of vapor manifold channels 310 of the Fractal 0 evaporator. That fractal layer FL'''1 had a perimeter-to-area ratio smaller than the perimeter-to-area ratio of vapor manifold channels 310 was not intended. Rather, the openings in fractal layer FL'''1 being smaller than designed was due to the relatively large tolerances of the chemical etching process used to form the openings. As those skilled in the art will appreciate, if the perimeter-to-area ratio of fractal layer FL'''1 were made larger than the perimeter-to-area ratio of vapor manifold channels 310, e.g., by increasing the size of the openings in fractal layer FL'''1, then Fractal 1 evaporator 300 would outperform the Fractal 0 evaporator.

Figure 11:
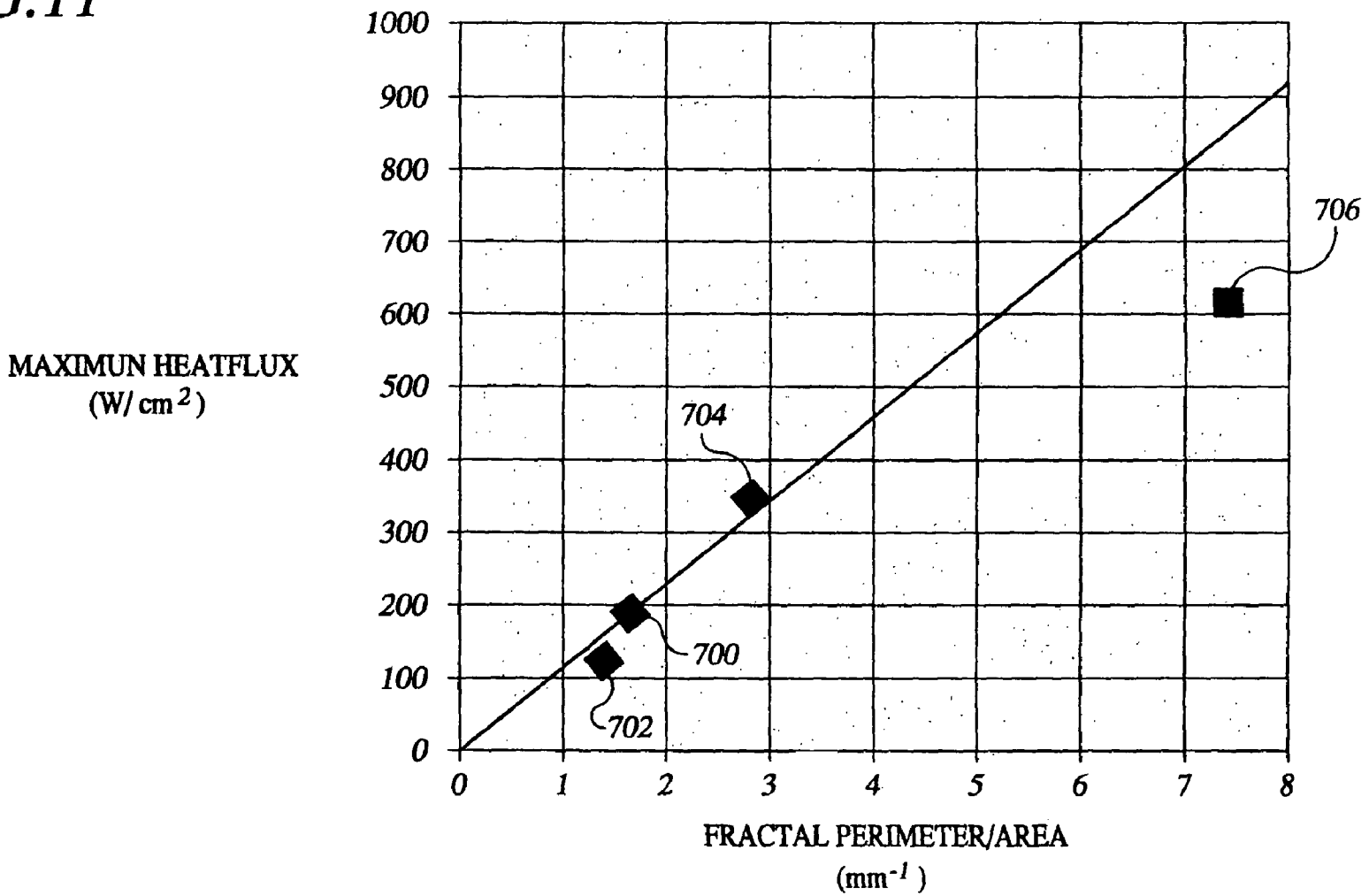
FIG. 11 is a graph of maximum measured heat flux versus the opening perimeter per unit area for the four test evaporators.
Figure 12:
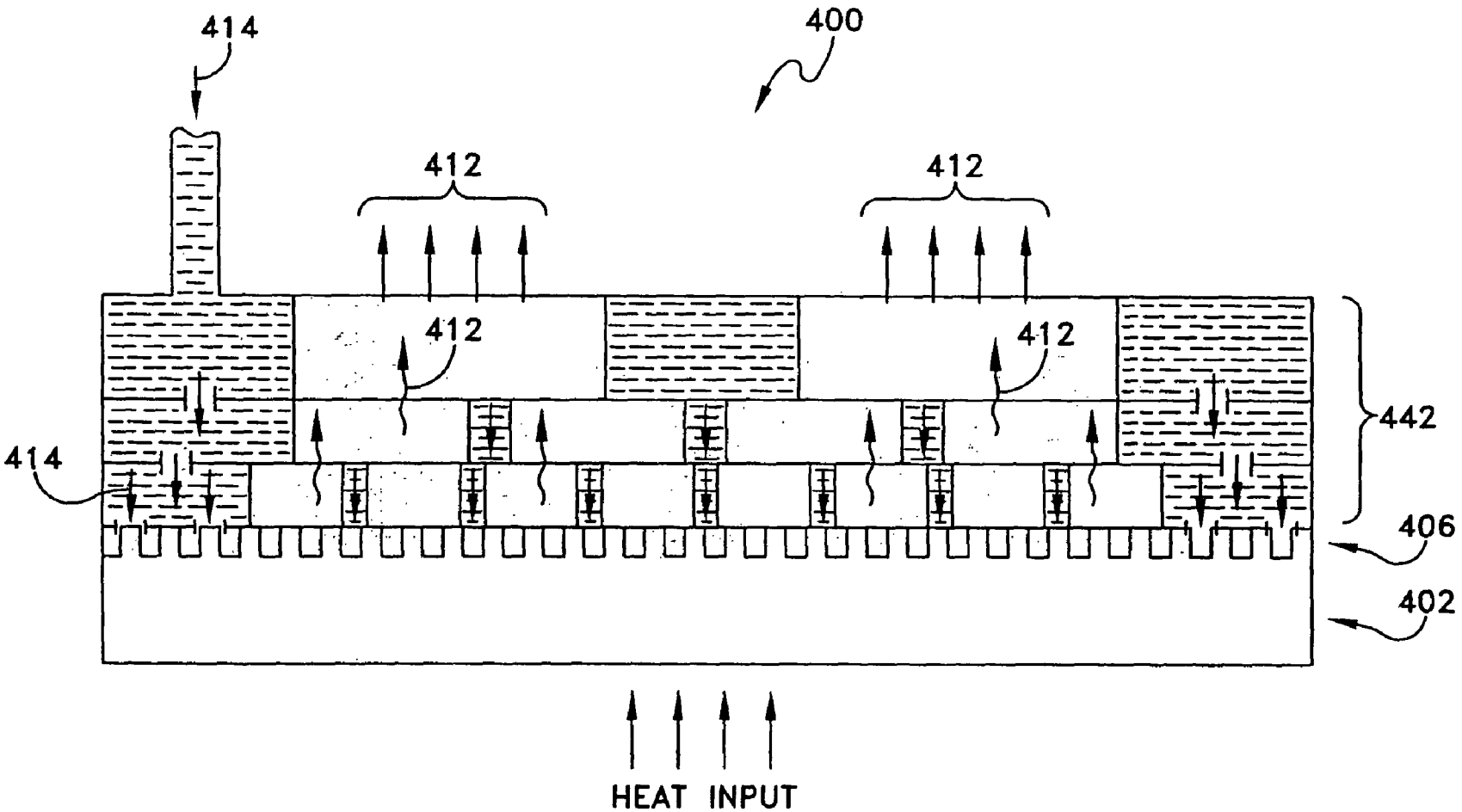
FIG. 12 is a schematic, cross-sectional view of a embodiment of a heat transfer device including a liquid vapor manifold.

FIG. 11 shows the maximum measured heat flux value 700, 702, 704, 706 for each of the Fractal 0, Fractal 1, Fractal 2, and Fractal 3 test evaporators 300, respectively, as a function of the opening perimeter-to-area ratio, i.e., the total of the perimeters of openings of the fractal layer, i.e., fractal layer FL'''1, FL'''2, or FL'''3 depending upon the evaporator, most proximate to capillary wick 320 divided by the footprint of that fractal layer. For Fractal 0, Fractal 1, and Fractal 2 evaporators 300, these values 700, 702, 704 also correspond to the heat flux that caused a dryout condition in capillary wick 320. Again, it is noted that the non-optimally executed fractal layer FL'''1 led to Fractal 0 evaporator 300 having a higher maximum heat flux than the Fractal 1 evaporator. Had fractal layer FL'''1 been more optimally executed, Fractal 1 evaporator 300 would have outperformed the Fractal 0 evaporator. For Fractal 3 evaporator, the dryout heat flux should be substantially larger than the 620 W/cm$^2$ value 706 measured, since at the end of the tests the thermal resistance was not showing any signs that capillary wick 320 was near its dryout heat flux.

From these results, it may be observed that the dryout heat flux varies linearly with the fractal opening perimeter per unit area. This observation agrees with the qualitative description in the background section, above, in connection with FIGS. 1A-C, that most of the evaporation in evaporator 20 takes place in very small regions near the contact areas between ribs 30 and capillary wick 24. Clearly, at some point this approximation will no longer hold, since the dryout heat flux cannot increase indefinitely. However, the measured permeability and capillary head of capillary wick 320 used in the Fractal 3 evaporator suggest that in an ideal evaporator the wick used for capillary wick 320 could support a heat flux of about 4,000 W/cm$^2$. Therefore, the addition of one or more additional fractal layers to fractal layers FL'''1-FL'''3 of Fractal 3 evaporator 300 would continue to yield increases in dryout heat flux that may result in nearly approaching the 4,000 W/cm$^2$ maximum heat flux of the corresponding ideal evaporator.

The thermal resistance of a capillary evaporator of the present invention can also be remarkably low. For example, Fractal 3 evaporator 300 had a thermal resistance of only 0.13° C./(W/cm$^2$). This value is about a factor of two lower than found in surface-wick evaporators of conventional heat pipes and an order of magnitude, or more, lower than the thermal resistances of current LHP and CPL evaporators. Generally, the addition of a vapor-side bridge, e.g., bridge 302, introduces additional heat-conduction resistance. However, the present results show that the decrease in evaporation resistance at the capillary wick, e.g., capillary wick 320, due to the addition of a vapor-side bridge more than compensates for the increase in heat-conduction resistance caused by the addition of this bridge.

Referring now to FIGS. 12-18, another embodiment of a heat transfer device for transferring heat to or from a fluid that is undergoing a phase change is illustrated. In this embodiment, the heat transfer device 400 includes a heat transfer interface 402 in thermal communication with a capillary wick or structure 406, and further includes a liquid-vapor manifold 442 in fluid communication with the capillary structure which operates to transport working liquid 414 in a first direction and also to conduct vapor 412 in a second direction, opposite the first direction.

When operating as an evaporator, the liquid enters the liquid-vapor manifold 442 through an inlet and is transported by the manifold in a direction toward the capillary structure. The liquid-vapor manifold may preferably include a plurality of discrete liquid delivery sites so as to selectively disperse the liquid over the surface of the capillary structure. As the vapor 412 rises from the surface of the capillary structure it is directed by the liquid-vapor manifold 442 away from the capillary structure. The vapor 412 is directed through multiple locations, the multiple locations being adjacent the capillary structure, as described in greater detail below. As used herein, the term "adjacent" means close to or near, but not necessarily abutting, whereas "immediately adjacent" is used to mean abutting.

Alternatively, the liquid-vapor manifold may operate as a condenser and direct the vapor 412 to the surface of the capillary structure and distribute the vapor through a plurality of delivery sites which are dispersed adjacent the surface of the capillary structure. The liquid 414 is then collected and transported by the liquid-vapor manifold 442 away from the capillary structure to an outlet. The liquid is collected and conducted at multiple locations, the multiple locations being adjacent the capillary structure. In either application the liquid and the vapor may be transported at adjacent sites, for example, within approximately a few millimeters of the delivery sites. Depending upon the application, the liquid is either transported into the heat transfer device from an external member or transported from the heat transfer device to the external member. A port (inlet or outlet) which is positioned at a distance from the capillary structure can be provided in order to transport the liquid to and from the external member.

The liquid-vapor manifold disclosed in the embodiments of FIGS. 12-18 provides a distributed supply of fluid (either liquid or vapor) over the surface of the capillary structure and also collects fluid generated at the surface of the capillary structure. This distributed supply eliminates the need to feed fluid through the capillary structure over long distances, thereby allowing the use of thinner wicks with smaller capillary passages. Thinner wicks, in turn, result in reduced thermal resistance and increased heat flux capability.

Figure 13:
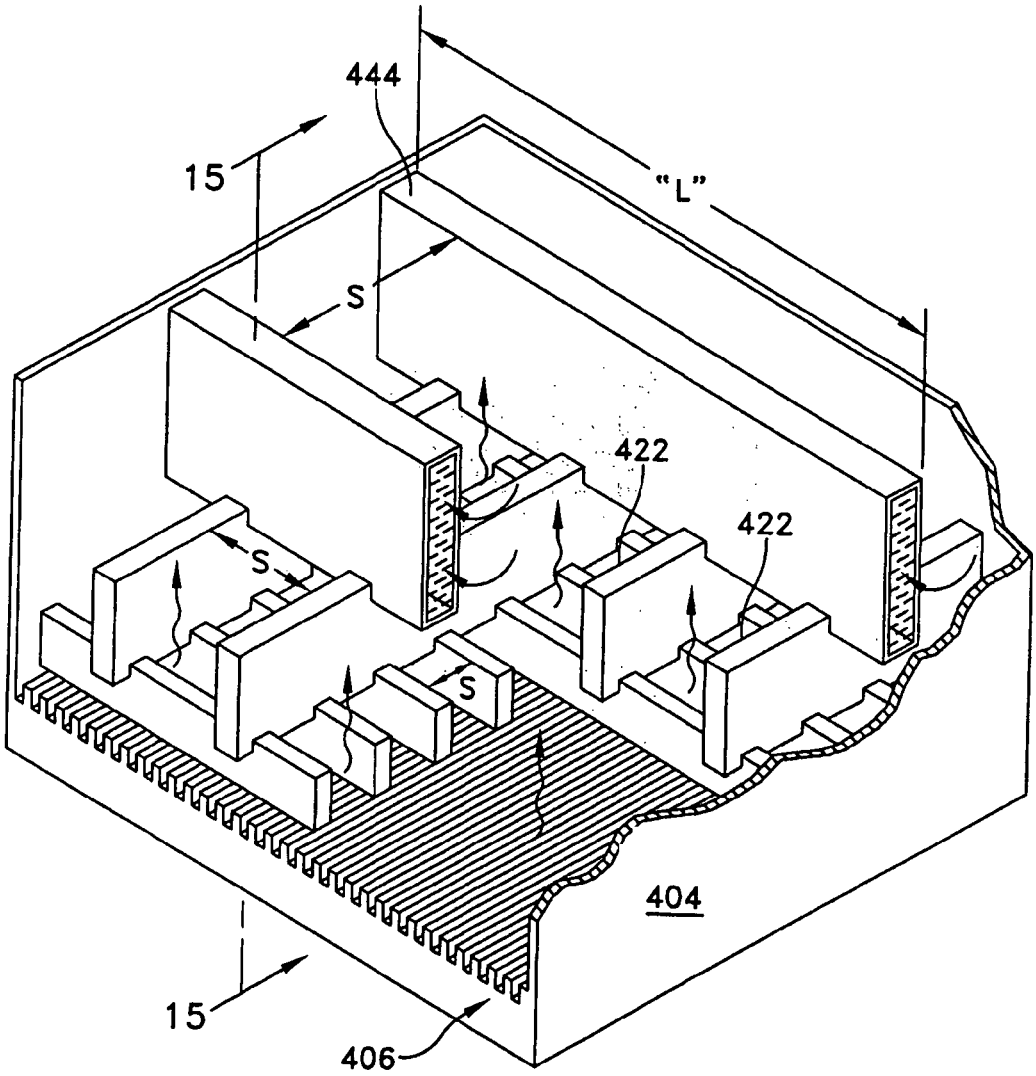
FIG. 13 is a perspective view of one embodiment of the heat transfer device of FIG. 12.
Figure 14:
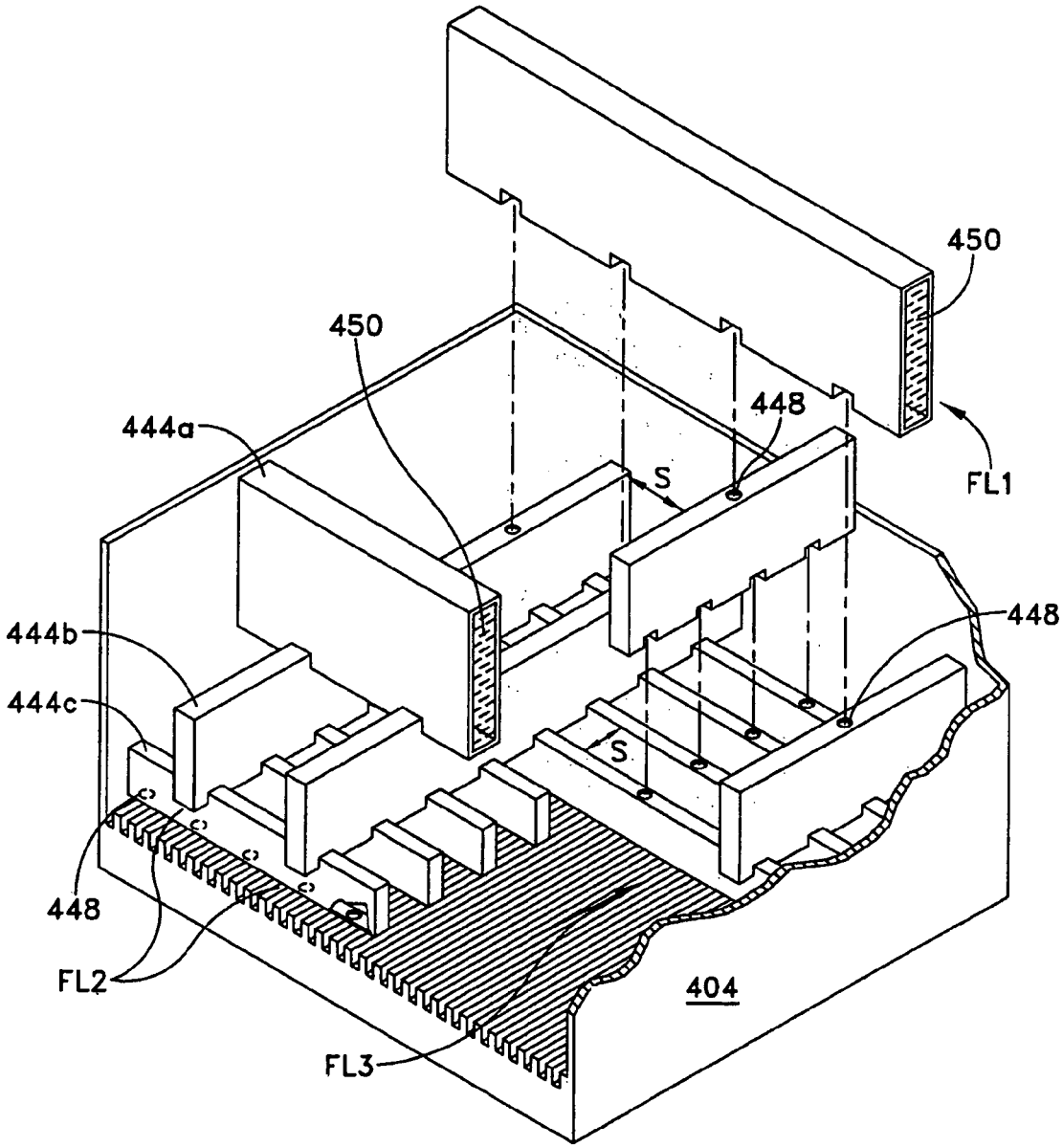
FIG. 14 is an exploded view of the liquid vapor manifold of the heat transfer device of FIG. 13.
Figure 15:
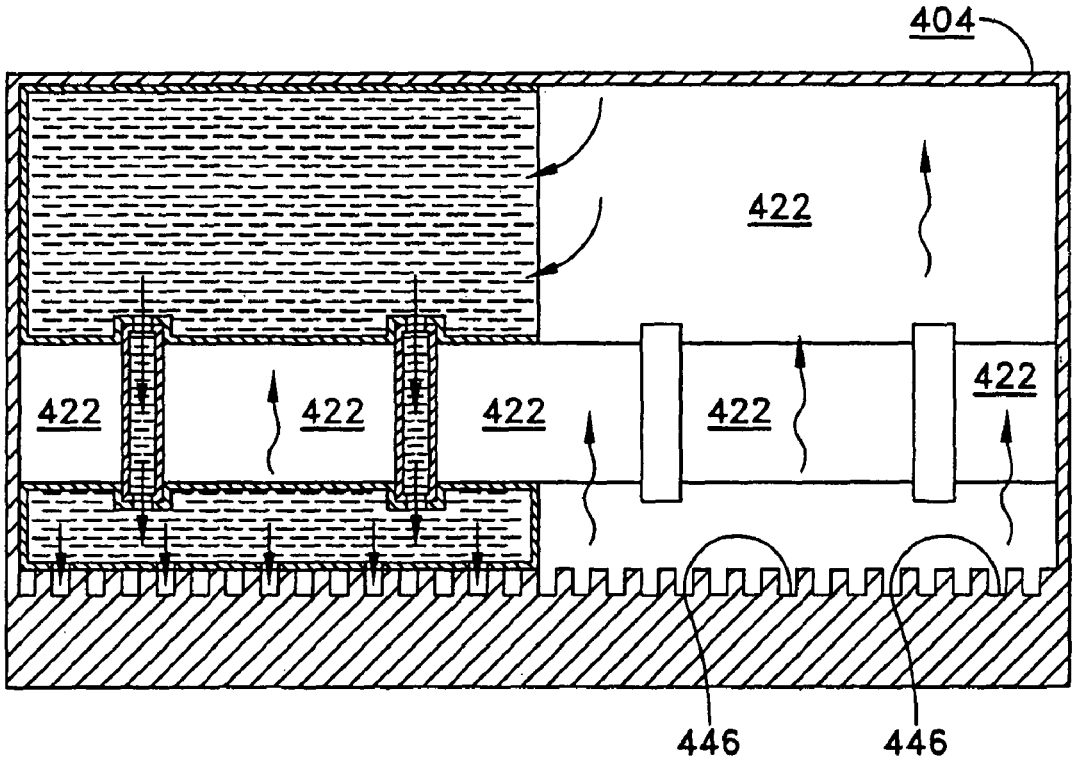
FIG. 15 is a cross sectional view taken along lines 15-15 of FIG. 13.

For either evaporator or condenser applications, in order to both distribute the liquid and conduct the vapor, the liquid-vapor manifold preferably includes a fractal geometry having a plurality of layers supported by the capillary structure 406. In the embodiment shown in FIGS. 13-15, each layer, FL1-FL3, is formed of a plurality of individual or separate conduits 444, each conduit defining a longitudinal axis "L" through which the working liquid flows. The direction the liquid flows through conduits 444 may be toward or away from the capillary structure 406, depending upon whether the device is operating as an evaporator (in which the direction would be toward the capillary structure) or a condenser (where the direction of liquid flow would be away from the capillary structure), as described above. In FIGS. 13-15 the fluid flow is shown for illustration only as if operating as an evaporator, and should not be construed as limiting.

The conduits 444*a, b, c* (FIG. 14) of adjacent layers are fluidly connected such that the working liquid can flow between the layers, with the proximal (or closest) conduit layer FL3 to the capillary structure 406 being in fluid communication with the capillary structure. In the present embodiment, conduits in adjacent layers are fluidly connected by apertures 448 (FIG. 14) formed in the conduits, which may otherwise be closed. When operating as an evaporator, the conduits of the distal most layer, FL1, may each be in fluid communication with a liquid source for example, a condenser, through openings 450. In such a case, the liquid-vapor manifold evaporator and condenser may be formed as part of a closed loop system, such that a constant flow of liquid and vapor is exchanged between the evaporator and the condenser, as described in greater detail below.

The conduit layers may preferably have the same geometry but have different scales, i.e. a "fractal" structure. More specifically, in the present embodiment the number of conduits in the proximal layer FL3, is preferably greater than the number of conduits in the next adjacent layer, FL2. The cross-sectional area of each of the conduits in the proximal layer FL3 is also preferably smaller than the cross-sectional area of the conduits in the adjacent layer, FL2. In the present embodiment, as multiple layers are added to the structure of FIG. 13, the number of conduits decreases in each adjacent layer in a direction away from the first, proximal layer and, likewise, the cross-sectional area of each conduit increases between adjacent layers in a direction away from the first, proximal layer. In other words, the furthest, or most distal layer will have the fewest number of conduits, but each of the conduits in the distal layer will have the largest cross-sectional area, as compared to other layers. The number of conduits increases with each successive layer as you move from the most distal layer (FL1 in the present embodiment) toward the capillary structure 406. Likewise, the cross-sectional area of the conduits in each layer decreases when moving between layers from the most distal layer toward the capillary structure. Within individual layers, for example FL1, FL2 and FL3, the cross-sectional area of each conduit is preferably substantially equal. This arrangement continues regardless of the number of layers which may be varied, depending upon the particular application. As illustrated, the conduits may have a rectangular structure, but the geometric shape of the conduits may be readily varied, as would be known to those of skill in the art. In addition, although it is preferred that the geometry of the conduits remain the same within a layer, the geometries may be varied between the layers.

In the present embodiment, the conduits in proximal layer FL3, are preferably disposed perpendicular to the conduits in the next, adjacent layer FL2. The conduits within a single layer are spaced a predetermined distance from each other, "S", which will differ from layer to layer. Within each layer the conduits are preferably disposed substantially parallel to each other. Whereas the conduits between adjacent layers are preferably positioned substantially perpendicular to each other. For example the conduits of FL1 are substantially perpendicular to those of FL2 which are substantially perpendicular to those of FL3, and so on. Therefore, alternating layers (FL1, FL3) are substantially parallel to each other. By placing the conduit layers in this grid-type arrangement, and by increasing the number of conduits while reducing their cross-sectional area between layers, a plurality of openings 422 are formed between the layers of conduits. As will be appreciated, as the number of conduits increase between the layers, the number of openings 422 for directing vapor flow between the conduits also increases. Likewise, as the number of the openings increases, the cross-sectional area of the openings decreases. Thus, the layers may have a fractal structure, i.e. the same geometry but in different scales. The openings 422 direct the flow of vapor through the liquid-vapor manifold, in a direction opposite the liquid flow, as described in greater detail below. The openings between the smallest conduits may be particularly small, for example in the range of about 0.5 to 5 mm.

The liquid-vapor manifold, particularly the most proximal layer, FL3, may be coextensive with the capillary structure 406 such that the conduits 444*c* extend across substantially the entire surface 406*a* of the capillary structure. When acting as either a condenser or evaporator, the liquid and vapor flows through the layers of conduits and vapor through the layers of openings as a result of the capillary pressure present in the system. When utilized as an evaporator, as the liquid hits the capillary structure vapor is formed and pulled up through the openings 422 by the capillary pressure. When utilized as a condenser, the vapor travels downward, toward the capillary structure and is delivered at a plurality of vapor delivery sites corresponding to the number of openings in the layer. The condensed liquid then flows in the upward direction, away from the capillary structure.

In the present embodiment, the capillary structure may preferably be formed as a single, unitary member with heat transfer interface 402 which is preferably formed as a single unitary member with housing 404 to contain the vapor. More specifically, the heat transfer interface 402 may include a plurality of channels, or narrow grooves 446 formed within the surface, for example by micromachining, which act as the capillary structure. The width and depth of the grooves can be selected to achieve the lowest thermal resistance at the required maximum heat flux for the particular application. The grooves could be micromachined using techniques such as chemical milling, photoetching, micro-edm, or plasma etching, as would be known to those of skill in the art.

Alternatively, the capillary structure may be formed as a separate member that is supported on the heat transfer interface 402, as described below with respect to FIGS. 16-18. For example, the capillary structure may be fabricated using an additive technique, such as electroforming, powder sintering, or thermal spraying. Those skilled in the art will appreciate the variety of materials, structures and fabrication methods that may be utilized for forming capillary structure 406.

Figure 16:
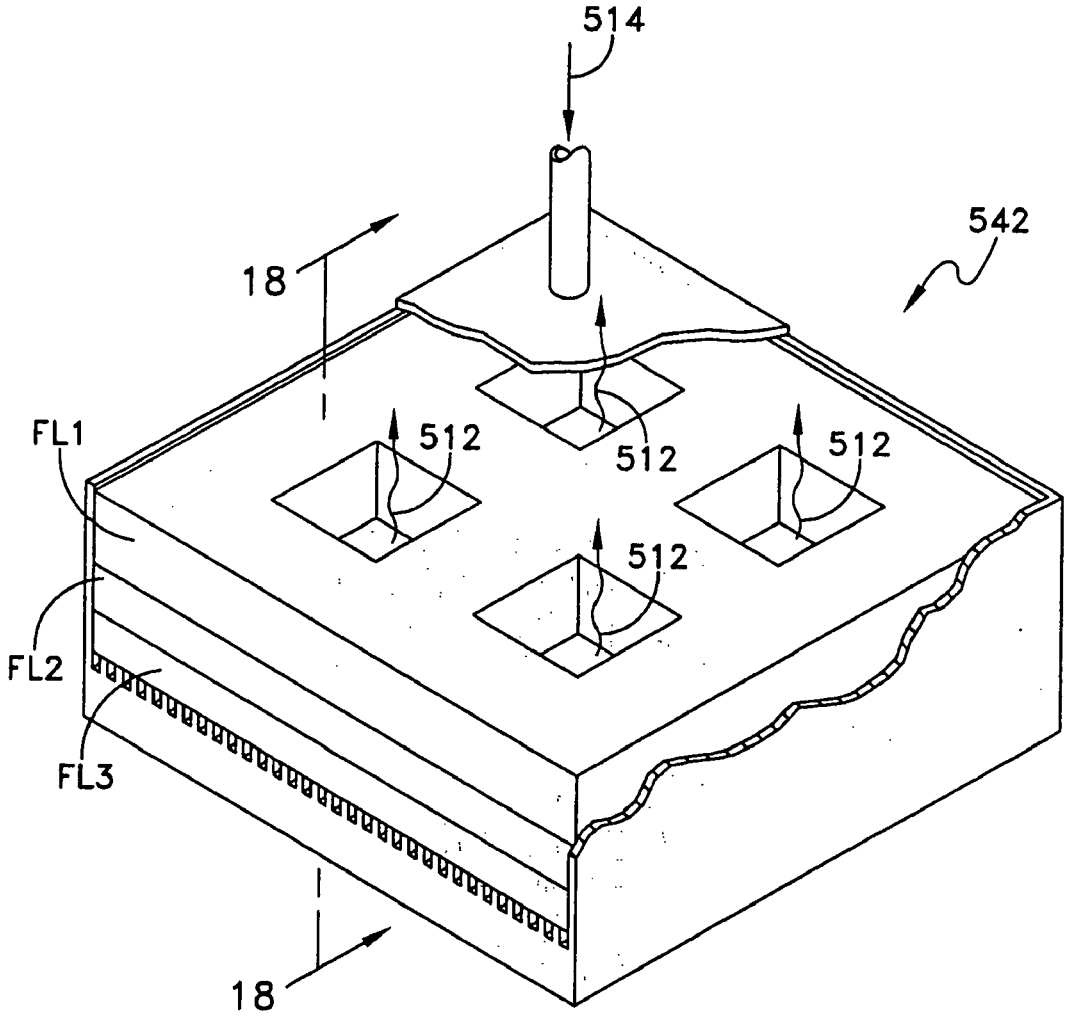
FIG. 16 is a perspective view of another embodiment of the heat transfer device of FIG. 12.
Figure 17:
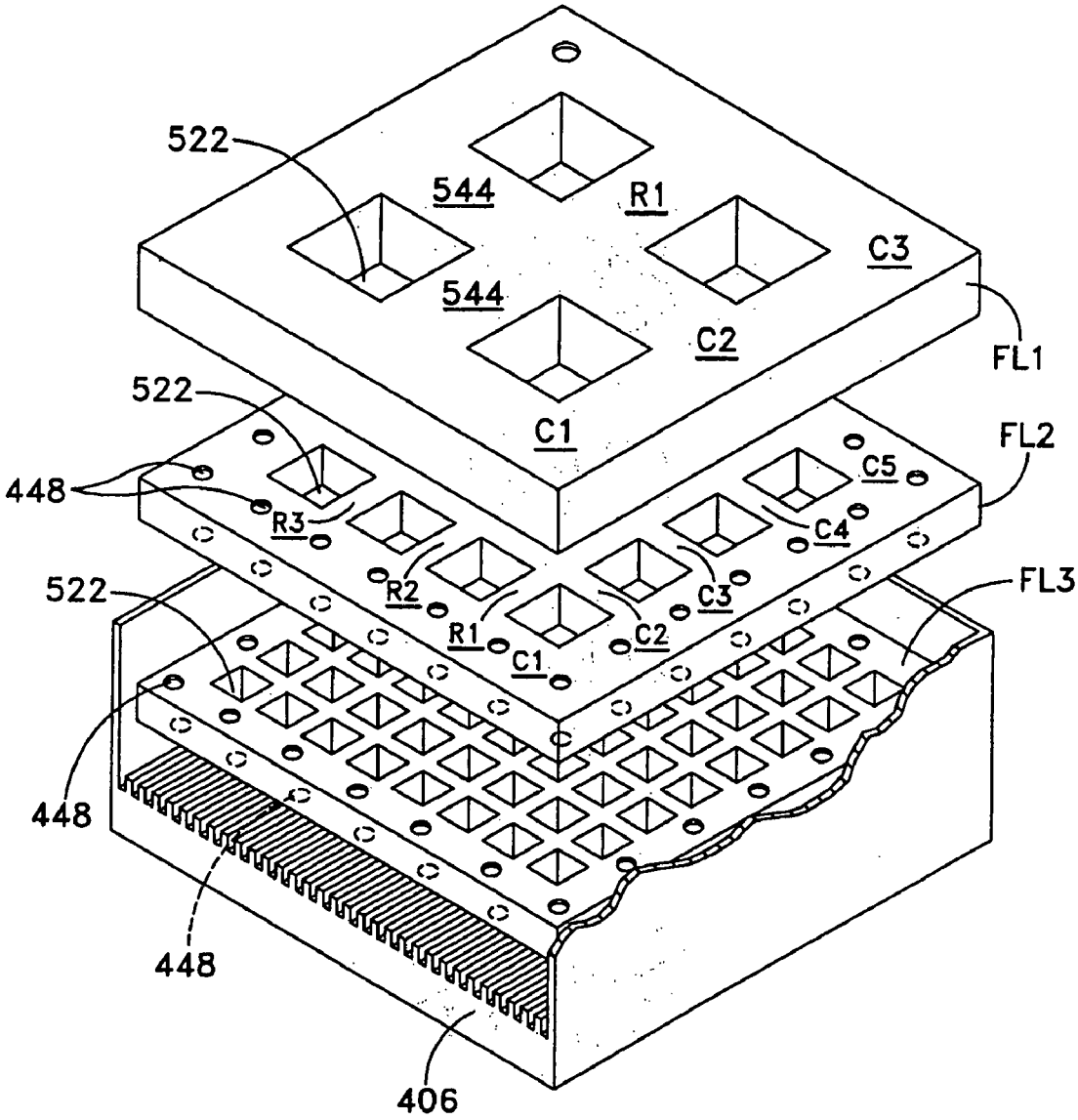
FIG. 17 is an exploded view of the liquid vapor manifold of the heat transfer device of FIG. 16.
Figure 18:
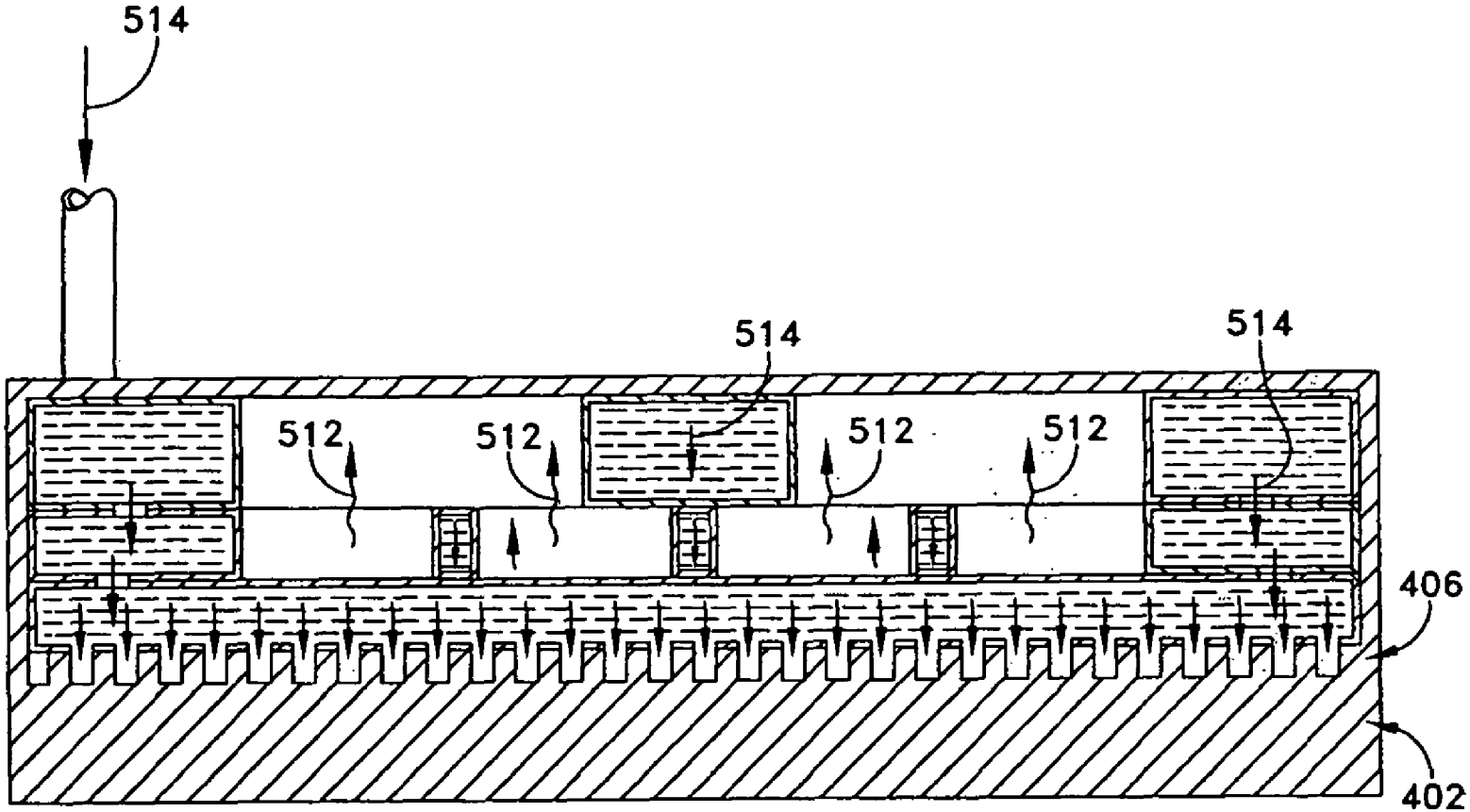
FIG. 18 is a cross sectional view taken along lines 18-18 of FIG. 16.

Referring now to FIGS. 16-18 an alternate embodiment of the heat transfer device including a liquid-vapor manifold 542 is illustrated. In this embodiment the liquid-vapor manifold also operates to transport working liquid 514 in a first direction and also to conduct vapor 512 in a second direction, opposite the first direction. The liquid-vapor manifold 542 may also have a fractal structure including multiple layers FL1, FL2, and F3, so as to distribute fluid at a plurality of delivery sites which are dispersed over the surface of the capillary structure. As with the previous embodiment, each layer FL1, FL2 and FL3, also includes one or more conduits 544. However, in the present embodiment, each of the conduits within a layer are fluidly interconnected with each other, in addition to being fluidly connected with the conduits of adjacent layers through openings 448. The proximal most conduit, likewise delivers the fluid through openings 448 onto the capillary surface. The openings 448 provide fluid communication between the layers and number, arrangement, and shape of openings 448 may be readily varied, as would be known to those of skill in the art, depending upon the particular application.

Each layer also further includes a plurality of openings 522 to conduct vapor. The openings 522 may be arranged within the layers such that conduits 544 within each layer are divided into a plurality of rows R1, R2, R3, etc. that intersect with a plurality of columns C1, C2, C3, etc. As with the embodiment of FIG. 13, the most proximal layer, FL3, has the most openings and therefore the most rows and columns, resulting in the greatest number of inter-connected conduits within the layer. Again, each successive layer moving away from FL3 toward FL1 will have fewer openings defining fewer rows and columns and having fewer conduits. As also described above, the cross-sectional area of the conduits decreases as their number increases toward the capillary structure. Likewise, the area of the openings 522 decreases in a direction toward the capillary structure as the number of openings increases. In the present embodiment, the layers are illustrated as having square shaped openings 522, however other shape openings may be utilized as would be apparent to those of skill in the art. The layers may preferably be stacked one on top of the other, with the proximal most layer FL3 being supported on the capillary structure 406. For proper alignment, the perimeter of each layer may preferably be approximately the same size, and the openings in adjacent layers may differ by a predetermined factor. In the present embodiment, the openings between layers differ by a factor of two, although a higher power of two could also be used.

In the present embodiment the capillary structure consists of a thin porous layer made out a high thermal conductivity material and in good thermal communication with the inside surface of the housing wall. As described above with respect to the embodiment of FIG. 13, the present device may function as either an evaporator, or a condenser, depending upon the direction of the flow of the fluid and liquid.

The liquid-vapor manifold of FIGS. 12-18 may be used within a closed loop system that continuously re-distributes liquid and vapor. In such a closed-loop system, the evaporator and condenser may share a common housing, as in the case of a heat pipe, or they may have separate housings connected through external piping, as in the case of a loop heat pipe. A different or conventional type of evaporator or condenser may be used in combination with an evaporator or condenser of the present embodiment which includes the liquid-vapor manifold. The specific configuration will be dictated by the requirements of the particular application. Alternatively, the liquid-vapor manifold could be used as part of an open loop system where liquid (or vapor) is continuously supplied from an external source and is thereafter expelled. Because the liquid-vapor manifold is not in the heat flow path, it may be fabricated out of a range of materials including, but not limited to metals, plastics, or ceramics. One fabrication approach is to electroform the manifold over a wax or thermoplastic structure. After electroforming, the wax or thermoplastic structure would be melted and removed, to leave the liquid manifold conduits behind. The manifold could also be fabricated by injection molding a polymer or by bonding laminations with passages etched in them.

The embodiment of FIGS. 12-18 in addition to having a thinner capillary structure which is expected to provide reduced thermal resistance and increased heat flux capabilities than prior art designs is also expected to provide increased heat transport capacity, the ability to tailor the heat transfer resistance over the surface of the device, the ability to use a wider range of materials, and to be readily scalable to large and small areas alike.

More specifically, the thermal resistance in a capillary evaporator is the sum of the conduction resistance between the heat acquisition interface and the evaporation interline region plus the evaporation resistance at the interline region. When used as an evaporator, the embodiments of FIGS. 12-18 are expected to have lower conduction resistance than prior art wall-wick evaporators because the capillary structure can be very thin. The conduction resistance is expected to be lower than the opposed-wick evaporators because there are no vapor passages between the heat acquisition interface and the interline region of the wick. Finally, the evaporation resistance should also be lower than in the opposed-wick evaporators because the capillary structure can have smaller passages and hence and increased evaporation area in the interline region.

The heat transport capacity of a capillary driven two-phase heat transfer device depends primarily on the pressure drop available for circulating the liquid and vapor between the evaporator and the condenser. This pressure drop is equal to the capillary head of the evaporator minus the internal pressure drop in the evaporator and condenser. The maximum heat transport capacity is reached when heat input results in a liquid and vapor flow rate that requires a pressure drop which exceeds the capillary head of the wick. To increase the thermal transport capacity it is desirable to maximize the capillary head and minimize the internal liquid and vapor pressure drops in the evaporator and condenser.

In the present liquid-vapor manifold, the pressure drop of the liquid and of the vapor in the manifold is low because when the fluids are transported over longer distances they flow in the larger conduits of the upper, or distal manifold layers. The fluids travel only the short distance between the distal manifold layers and the capillary structure in the progressively smaller, but more numerous conduits of the lower manifold layers. In particular, the liquid side pressure drop should be appreciably lower than that in prior art wall-wick evaporators, and the vapor pressure drop should be appreciably lower than that in prior art opposed-wick evaporators. Hence the sum of the liquid and vapor pressure drops should be significantly lower than in both types of prior art evaporators.

The liquid pressure drop in the capillary structure itself is also relatively small in the embodiment of FIGS. 12-18 because the liquid is supplied to the capillary structure at many locations distributed over the heat transfer interface. Hence the distance that the fluid has to flow through the capillary structure is an order of magnitude less than in prior art evaporators. Because the distance the liquid must flow through the capillary structure is very short, the passage size in the capillary structure can be made much smaller than in prior art evaporators without incurring excessive pressure drop. Smaller passages, in turn, result in an increased capillary head. Increased capillary head combined with low liquid and vapor pressure drops result is a much higher heat transport capacity.

Even if the total heat input to the evaporator is below the heat transport limit of the device, the evaporator can fail if the local heat flux exceeds a maximum value. For prior art wall-wick evaporators, this maximum heat flux level is typically less than 20 W/cm2. For most prior art opposed-wick evaporators the maximum heat flux is somewhat higher, around 50 W/cm2. It is anticipated that the evaporator of embodiments of FIG. 12-18 will have a heat flux capability order of magnitude higher than that of prior art wall-wick evaporators and most prior art opposed-wick evaporators. The two phenomena that limit the maximum heat flux that can be absorbed by a capillary evaporator are: (1) the capillary pumping limit of the wick, and (2) the onset of nucleate boiling in the capillary structure. As described above, the distributed liquid supply greatly reduces the distance the liquid must flow through the small conduits to the capillary structure. Hence, higher liquid flow rates are possible before reaching the capillary pumping limit of the capillary structure. The low thermal resistance of the evaporator will reduce the superheat at the base of the capillary structure for a given heat flux and thereby delay the onset of nucleate boiling.

The embodiments of FIGS. 12-18 also provide the user with the ability to tailor the thermal resistance. In prior art evaporators the available capillary head at one location is affected by the evaporation rate at other locations because the internal liquid and vapor pressure drops can be high. The low pressure drop manifold in the present embodiments reduces the coupling between different regions of the evaporator. This allows local modification of the thermal resistance of the capillary structure without affecting conditions at other regions. This could be particularly relevant is some high heat flux cooling applications, such as cooling microprocessors, where it would be desirable to fabricate the evaporator housing wall out of a material that has both high thermal conductivity and low coefficient of thermal expansion. Candidate materials may include, for example, Si, SiC, AlN, diamond, pyrolytic graphite, or various composites of these materials. The capillary structure of the heat exchanger of the present embodiments could be micromachined directly on the surface of any of these materials.

Capillary evaporators are limited in size by the internal pressure drops in the wick (for wall-wick evaporators) or in the vapor channels (for opposed-wick evaporators). These limitations are not present in the heat exchanger of the present embodiments because the liquid and vapor pressure drops can be kept within allowable limits as the size of the heat transfer device surface is increased by increasing the number of layers and the size of the passages in the liquid-vapor manifold.

Thus, it will be appreciated that the liquid-vapor manifold has many possible uses.

While the present invention has been described in connection with specific preferred embodiments, it will be understood that it is not so limited and that these embodiments are exemplary. Various modifications may be made to the embodiments disclosed herein which are within the spirit, scope and intent of the invention. For example, although the liquid-vapor manifold is illustrated and described as including a plurality of layers FL that are separate, the layers may be present within a monolithic structure. In addition, the use of the term "fractal" herein is not intended to imply that the shapes and patterns must be the same from one layer FL to the next layer, nor that there be any formal mathematical relationship among the scale factors between adjacent layers, if more than two layers are used. Also, the liquid vapor manifold need not have a "fractal" geometry as long as the vapor and liquid are dispersed over the capillary structure at multiple delivery sites such that the distance between the distribution of one and the carrying away of the other is closely spaced. These modifications as well as others are within the scope, spirit and intent of the invention as defined by the claims. Therefore, all embodiments that come within the intent, scope and spirit of the following claims and equivalents thereto are claimed as the invention.

What is claimed is:

1. A heat transfer device for transferring heat to or from a fluid that is undergoing a phase change, the heat transfer device comprising:

a) an inlet adapted to receive a supply of working liquid;

b) a capillary structure spaced from the inlet and adapted to move the fluid by capillary action;

c) a heat transfer interface in thermal communication with the capillary structure;

d) a liquid-vapor manifold constructed and arranged to deliver liquid from the inlet to the capillary structure, the liquid-vapor manifold being further constructed and arranged to direct vapor dispersed by the capillary structure in a direction away from the capillary structure, the liquid-vapor manifold including:

at least a first layer proximal to the capillary structure and at least a second, distal layer, each of the layers including a plurality of conduits, the conduits in adjacent layers being in fluid communication with each other, the conduits of the first, proximal layer being in fluid communication with the capillary structure, each of the conduits being constructed and arranged to transport liquid in a direction from the inlet toward the capillary structure, each of the layers also including one or more openings configured and dimensioned to transport the vapor dispersed by the capillary structure in the direction away from the capillary structure; and a plurality of discrete liquid delivery sites so as to disperse the liquid over the capillary structure;

e) a housing constructed and arranged to enclose at least the liquid-vapor manifold so as to contain the vapor; and wherein adjacent layers have an increasing number of conduits when moving in a first direction toward the proximal layer and capillary structure, and wherein a cross-sectional area of each of the conduits decreases between adjacent layers in the first direction toward the proximal layer and capillary structure.

2. The heat transfer device of claim 1, wherein the liquid-vapor manifold has a fractal structure such that adjacent layers further include an increasing number of openings when moving in the first direction toward the proximal layer and capillary structure, and wherein the area of the openings in each layer decreases between adjacent layers in the first direction toward the proximal layer and capillary structure.

3. The heat transfer device of claim 1, wherein each conduit within a layer is formed as a separate member, each conduit having a longitudinal axis, and wherein each conduit within a single layer is disposed such that their longitudinal axis are substantially parallel to the other conduits in that layer.

4. The heat transfer device of claim 3, wherein the first, proximal layer is in contact with the capillary structure such that the longitudinal axis of each conduit in the proximal layer is substantially perpendicular to grooves formed in the capillary structure.

5. The heat transfer device of claim 4, wherein adjacent layers of conduits are orientated with their longitudinal axis substantially perpendicular to the axis of conduits in adjacent layers.

6. The heat transfer device of claim 1, wherein the one or more conduits in each layer are formed as a single, unitary member such that the conduits are interconnected, the single, unitary member further including a plurality of openings disposed therethrough.

7. The heat transfer device of claim 6, wherein adjacent layers have an increasing number of openings when moving in a first direction toward the capillary structure, and wherein a cross-sectional area of the openings decreases between adjacent layers in the first direction toward the capillary structure.

8. The heat transfer device of claim 7, wherein the plurality of openings all have the same geometric shape.

9. The heat transfer device of claim 6, wherein each unitary member has a thickness, the thicknesses increasing with increasing distance of the corresponding ones of the members from the capillary structure.

10. The heat transfer device of claim 2, wherein the liquid-vapor manifold is substantially coextensive with the capillary structure.

11. The heat transfer device of claim 10, in combination with a condenser, the condenser being constructed and arranged to receive the vapor and to condense the vapor to a liquid.

12. The combination of claim 11, wherein the heat transfer device and the condenser form a closed loop system disposed within the housing such that the vapor formed by the heat transfer device is fed to the condenser and becomes liquid, the liquid being brought back to heat transfer device through the liquid vapor interface.

13. A heat transfer device for transferring heat to or from a fluid that is undergoing a phase change, the heat transfer device comprising:

a) an outlet adapted to receive a supply of working liquid;

b) a capillary structure spaced from the outlet and adapted to move the fluid by capillary action;

c) a heat transfer interface in thermal communication with the capillary structure;

d) a liquid-vapor manifold including a plurality of discrete liquid collection sites constructed and arranged to collect liquid adjacent the surface of the capillary structure and to transport the liquid in a direction away from the capillary structure toward the outlet, and further constructed and arranged to transport vapor in a direction toward the capillary structure, and wherein the liquid vapor manifold includes at least a first layer proximal to the capillary structure and at least a second, distal layer, each of the layers including one or more conduits, the conduits in adjacent layers being in fluid communication with each other, the conduits of the first, proximal layer being in fluid communication with the capillary structure, each of the conduits being constructed and arranged to transport liquid in the direction away from the capillary structure and toward the outlet, and each of the layers further including one or more openings configured and dimensioned to transport the vapor toward the capillary structure;

e) a housing constructed and arranged to enclose the liquid-vapor manifold so as to contain the vapor; and wherein adjacent layers have an increasing number of conduits when moving in a first direction toward the proximal layer and capillary structure, and wherein a cross-sectional area of each of the conduits decreases between adjacent layers in the first direction toward the proximal layer and capillary structure.

14. The heat transfer device of claim 13, wherein the liquid-vapor manifold has a fractal structure such that adjacent layers further include an increasing number of openings when moving in the first direction toward the proximal layer and capillary structure, and wherein the area of the openings in each layer decreases between adjacent layers in the first direction toward the proximal layer and capillary structure.

15. The heat transfer device of claim 13, wherein each conduit within a layer is formed as a separate member, each conduit having a longitudinal axis, and wherein each conduit within a single layer is disposed such that their longitudinal axis are substantially parallel to the other conduits in that layer.

16. The heat transfer device of claim 15, wherein the first, proximal layer is in contact with the capillary structure such that the longitudinal axis of each conduit in the proximal layer is substantially perpendicular to grooves formed in the capillary structure.

17. The heat transfer device of claim 16, wherein adjacent layers of conduits are orientated with their longitudinal axis substantially perpendicular to the axis of conduits in adjacent layers.

18. The heat transfer device of claim 13, wherein the one or more conduits in each layer are formed as a single, unitary member such that the conduits are interconnected, the single, unitary member further including a plurality of openings disposed therethrough.

19. The heat transfer device of claim 18, wherein adjacent layers have an increasing number of openings when moving in a first direction toward the capillary structure, and wherein a cross-sectional area of the openings decreases between adjacent layers in the first direction toward the capillary structure.

20. The heat transfer device of claim 19, wherein the plurality of openings all have the same geometric shape.

21. The heat transfer device of claim 18, wherein each unitary member has a thickness, the thicknesses increasing with increasing distance of the corresponding ones of the members from the capillary structure.

22. The heat transfer device of claim 13, wherein the liquid-vapor manifold is substantially coextensive with the capillary structure.

23. The heat transfer device of claim 22, in combination with an evaporator, the evaporator being constructed and arranged to receive the vapor and to condense the vapor to a liquid.

24. The combination of claim 23, wherein the heat transfer device and the evaporator form a closed loop system disposed within the housing such that the liquid formed by the heat transfer device is fed to the evaporator and becomes vapor, the vapor being brought back to heat transfer device through the liquid vapor interface.

25. A heat transfer device for transferring heat to or from a fluid that is undergoing a phase change, the heat transfer device comprising:

a) a capillary structure spaced from the port and adapted to move the fluid by capillary action;

b) a heat transfer interface in thermal communication with the capillary structure;

c) a liquid-vapor manifold in fluid communication with the capillary structure, the liquid-vapor manifold having at least a first, proximal layer adjacent the capillary structure and a second, distal layer, each layer including:

(i) one or more conduits constructed and arranged to direct liquid between an external member and the capillary structure, wherein adjacent layers have an increasing number of conduits when traveling in a first direction toward the first surface of the capillary structure, and wherein a cross-sectional area of the conduits decreases in the first direction between layers;

(ii) a plurality of openings configured and dimensioned to direct vapor in a direction opposite the flow of the liquid, wherein adjacent layers have an increasing number of openings in a direction toward the capillary structure, and wherein the cross-sectional area of the openings decreases in the first direction between layers;

d) a port constructed and arranged to deliver liquid between the liquid-vapor manifold device and an external member; and e) a housing constructed and arranged to enclose the liquid-vapor manifold so as to contain the vapor.

26. The heat transfer device of claim 1, including at least a third layer including one or more conduits, the at least a third layer being disposed between the first layer and the second layer.

27. The heat transfer device of claim 13, including at least a third layer including one or more conduits, the at least a third layer being disposed between the first layer and the second layer.

28. The heat transfer device of claim 25, including at least a third layer including one or more conduits, the at least a third layer being disposed between the first layer and the second layer;

c) a liquid-vapor manifold in fluid communication with the capillary structure, the liquid-vapor manifold having at least a first, proximal layer adjacent the capillary structure and a second, distal layer, each layer including:

(i) one or more conduits constructed and arranged to direct liquid between an external member and the capillary structure, wherein adjacent layers have an increasing number of conduits when traveling in a first direction toward the first surface of the capillary structure, and wherein a cross-sectional area of the conduits decreases in the first direction between layers;

(ii) a plurality of openings configured and dimensioned to direct vapor in a direction opposite the flow of the liquid, wherein adjacent layers have an increasing number of openings in a direction toward the capillary structure, and wherein the cross-sectional area of the openings decreases in the first direction between layers;

d) a port constructed and arranged to deliver liquid between the liquid-vapor manifold device and an external member; and e) a housing constructed and arranged to enclose the liquid-vapor manifold so as to contain the vapor.

* * * * *